United States Patent [19]

Council

[11] 4,085,796

[45] Apr. 25, 1978

[54] WELL TUBING HANDLING SYSTEM

[75] Inventor: Malcolm N. Council, Richardson, Tex.

[73] Assignee: Otis Engineering Corporation, Dallas, Tex.

[21] Appl. No.: 742,331

[22] Filed: Nov. 16, 1976

[51] Int. Cl.[2] ..... E21B 33/03

[52] U.S. Cl. ..... 166/77.5; 173/149

[58] Field of Search ..... 166/77, 77.5; 173/149, 173/150

[56] References Cited

U.S. PATENT DOCUMENTS

| | | | |
|---|---|---|---|
| 2,126,933 | 8/1938 | Stone et al. | 173/149 |
| 3,708,020 | 1/1973 | Adamson | 173/149 |

*Primary Examiner*—James A. Leppink

*Attorney, Agent, or Firm*—H. Mathews Garland

[57] ABSTRACT

A well tubing handling system for running and pulling well tubing including a flange assembly for coupling the system on a wellhead, a central telescoping stabilizer tube assembly mounted on the flange assembly and comprising meshing splined outer lower and concentric upper inner tubes, an upper traveling slip assembly secured on the upper end of the upper inner stabilizer tube for gripping well tubing for raising or lowering the tubing through the stabilizer tube assembly, two sets of diametrically opposed hydraulic cylinder assemblies having piston rods connected with the upper traveling slips for raising and lowering the slips, two sets of lower slips mounted in axial alignment below the stabilizer tube assembly for holding the tubing against upward or downward movement while resetting the upper traveling slips, and a work platform mounted on the upper end of the stabilizer tube assembly for operators and the necessary control panels and the like. The sets of cylinder assemblies are of different sizes to provide maximum operating speeds at selected handling capacities. The stabilizer tube assembly permits maximum extension of the piston and cylinder assemblies with minimum twisting and lateral deflection and, thus, maximum stability. Two optional hydraulic control systems are disclosed to provide a substantial number of snubbing and pulling speeds. A variable volume hydraulic pump operated at maximum discharge volume and pressure is used to drive the cylinder assemblies with the maximum speed of snubbing and pulling at each required capacity being obtained pressurizing selected chambers of selected pairs of cylinder assemblies.

19 Claims, 16 Drawing Figures

WELL TUBING HANDLING SYSTEM

This invention relates to well tubing handling systems and more particularly relates to well snubbing apparatus used for running and pulling well tubing through a wellhead under pressure.

Well "snubbing" apparatus, which is industry terminology for well tubing handling systems employed in running and pulling well tubing under pressure, particularly, for well workover operations, has been known for many years. It is common practice to use cable and pulley arrangements and hydraulic cylinder assembly systems both alone and in combinations for lifting well tubing from a well and for pushing the well tubing downwardly in the well against well pressure. Some such systems are mounted on and supported solely from the wellhead structure while others involve the use of fairly substantial platform type structure including derrick type frameworks and the like around the running and pulling system. In such systems of the type of the present invention where the operating structure is mounted on the wellhead, lateral stability is a major problem limiting the length of the stroke of the device. It will be apparent that within practical limits of equipment weight, height, and related factors it is desirable to have as long a stroke as possible. The shorter the stroke of such a system, the more times it is necessary to engage and disengage the driving slips and, thus, the longer it takes to raise or lower a given length of tubing.

One of the most vital factors in the operation of well snubbing apparatus is the cost of servicing a well with the apparatus. Such cost is directly related to the time factor which is primarily affected by the speed of operation of the apparatus. In addition to the number of cycles required for the apparatus to run or pull a given length of well tubing, the actual weight which the apparatus can handle is an important factor. Usually, such apparatus is rented or leased on a time basis and the cost of operation is additionally affected by the cost of paying the wages of the operators. A still further element in the total expense of servicing a well is the length of time the well is shut down and, thus, not producing an income. Several of the prior art snubbing systems are capable of multiple speed operation though, insofar as presently known, three speeds are the maximum available with current available units. It will be readily recognized that it is highly desirable to provide additional operating speeds varied in as small increments as possible so that at a given power input the speed of operation of the system may be increased as rapidly as possible and, alternatively, decreased in as small increments as possible as the weight being handled changes. In this manner, the weight and speeds are closely coordinated with the ultimate result of performing a given job in a minimum amount of time.

It is, therefore, a principal object of the invention to provide a new and improved system for running and pulling well tubing.

It is another object of the invention to provide apparatus of the character described which is mounted on a wellhead.

It is another object of the invention to provide a well snubbing system which employes a stabilizing tube assembly to provide maximum lateral stability and minimize twisting for increased stroke length.

It is another object of the invention to provide a well servicing system of the character described which is operable over a wide range of speeds using a maximum number of speed change increments so that changes in speed are closely correlated with changes in weight handled by the system.

It is another object of the invention to provide a well system of the character described which achieves operational speed changes by selective pressuring of hydraulic cylinder assemblies of different sizes.

It is another object of the invention to provide a well servicing system of the character described wherein a maximum number of speed changes are attained with a constant output pump in minimum increments by use of two sets of diametrically-opposed, double-acting piston and cylinder assemblies wherein one of such sets is of a different size from the other of such sets by a predetermined value which controls the available speed change increments.

It is another object of the invention to provide a well servicing system of the character described which is stabilized by the use of a telescoping stabilizing tube assembly centrally disposed within hydraulic cylinders used for raising and lowering the well tubing handled by the system.

In accordance with the present invention, there is provided a well servicing or snubbing device for handling well tubing to run and pull the tubing in a well bore, including a flange assembly for mounting the device on a wellhead, a central telescoping stabilizing tube assembly supported on the flange assembly, an upper traveling slip assembly mounted on the upper end of the stabilizing tube assembly for raising and lowering a well tubing string, a plurality of sets of diametrically opposed piston and cylinder assemblies mounted on the flange assembly supporting the traveling slip assembly and upper end of the stabilizing tube assembly for hydraulically raising and lowering the traveling slip assembly, a work platform and control panel mounted on the stabilizing tube assembly for operating personnel, a hydraulic power system including a source of hydraulic fluid pressure and control valves for selectively pressuring the cylinder assemblies for varying the running and pulling speeds of the system, and fixed lower slips for supporting a well tubing string between the cycles of operation of the upper traveling slip assembly.

The foregoing objects and advantages of the invention will be better understood from the following detailed description thereof taken in conjunction with the accompanying drawings wherein:

FIGS. 1A and 1B taken together form a longitudinal view in elevation, partially broken away, of a well tubing handling system constructed in accordance with the invention mounted on a wellhead for running and pulling well tubing through the wellhead;

Figure 1A:
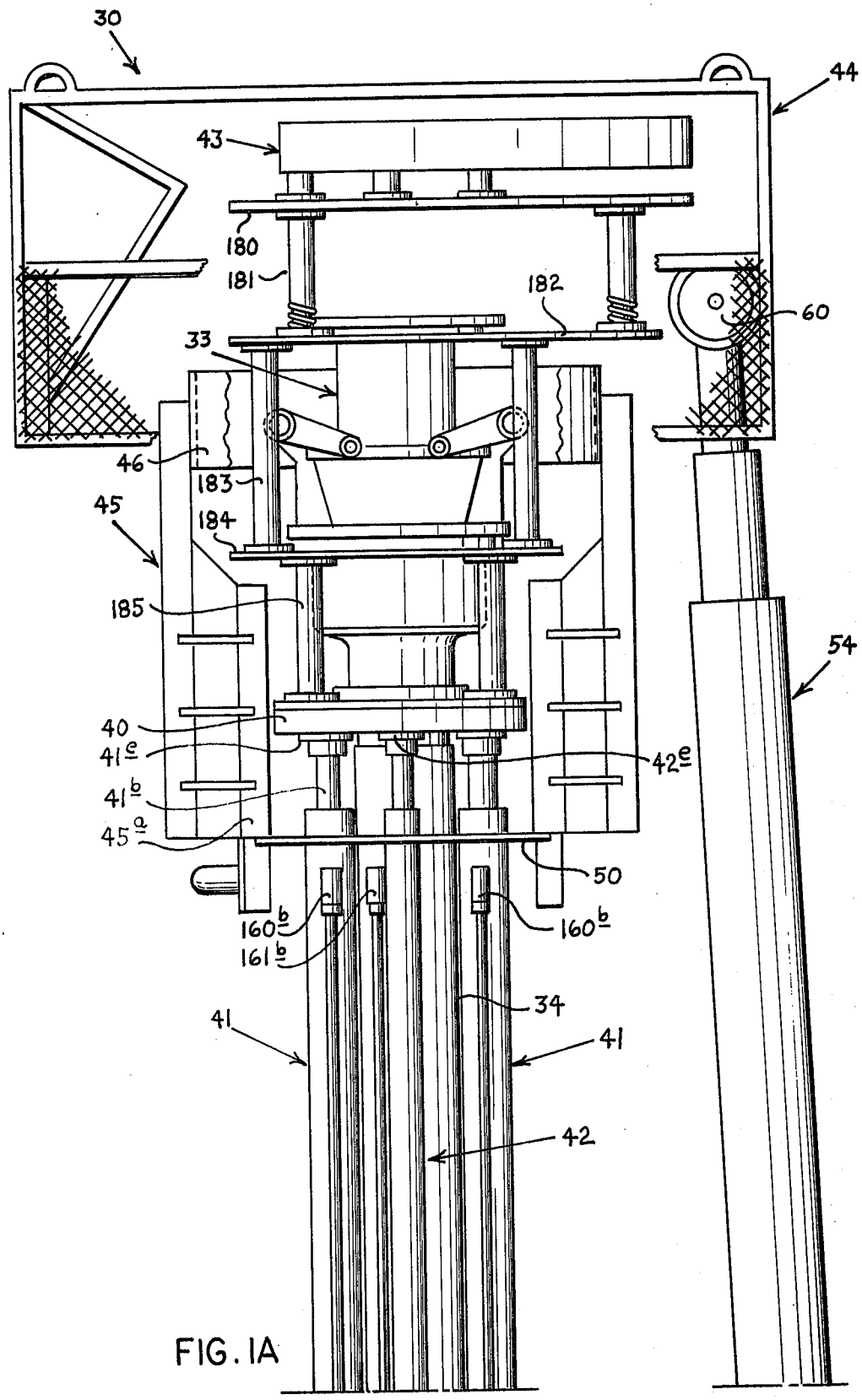
Figure 1B:
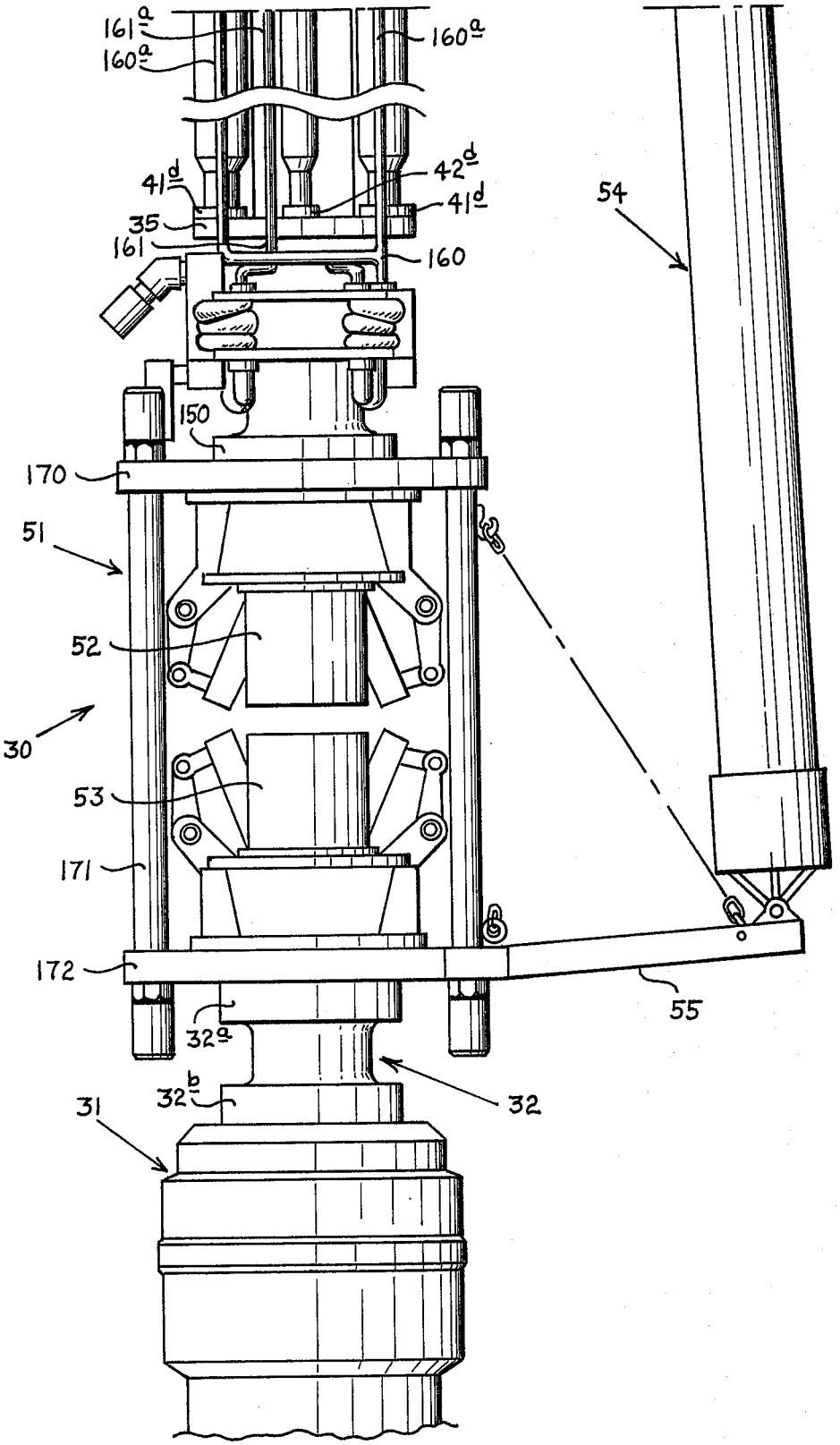

Referring to FIGS. 1A and 1B, a well tubing system 30 embodying the features of the invention is shown mounted on a well having a head provided with a blowout preventer 31. The well servicing system 30 is secured with the blowout preventer 31 by a spool 32 having an upper flange 32*a* and a lower flange 32*b*. The blowout preventer 31 is a standard type which includes an internal bag arrangement which may be pressurized to close around a well tubing passing through the preventer for preventing leakage along the tubing as the tubing is inserted into and pulled from a well. Preferrably, the blowout preventer 31 is mounted on additional conventional ram-type blowout preventers supported on a master valve mounted on a wellhead which is secured on the upper end of the well casing, all of which are conventional wellhead and safety components which, for purposes of brevity, are not shown herein but may be seen in U.S. Pat. No. 3,215,203 issued Nov. 2, 1965, to Phillip S. Sizer entitled APPARATUS FOR MOVING A WELL FLOW CONDUCTOR INTO OR OUT OF A WELL. In such reference patent, FIG. 1A illustrates a wellhead assembly including conventional valves, blowout preventers, and the like.

Figure 13:
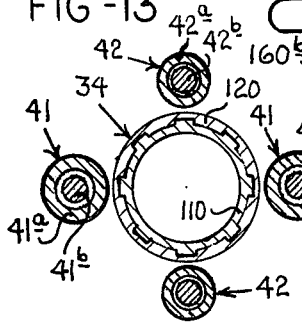
FIG. 13 is a view in section along the line 13—13 of FIG. 12.

The well servicing system 30, more commonly known in the industry as a "snubber", includes an upper traveling slip assembly 33 supported on the upper end of a central telescoping stabilizing tube assembly 34 which is mounted on a bottom plate 35. The upper traveling slip assembly 33 is secured on a top plate 40 which is supported on the piston rods of two pairs of diametrically opposed piston and cylinder assemblies 41 and 42 which are hydraulic rams used for raising and lowering the upper traveling slip assembly for running and pulling the well tubing in a well bore. The hydraulic units 41 and 42 are mounted on the bottom plate 35 symetrically disposed around the stabilizing tube assembly 34 arranged as illustrated in FIG. 13. The hydraulic units 41, which shall be referred to as the "large" units are positioned 180° apart on opposite sides of the stabilizing tube assembly, while, similarly, the hydraulic units 42, which shall be referred to as the "small" units, are also positioned on opposite sides of the stabilizing tube assembly 180° apart and spaced 90° from the large units 41. Such arrangement permits the application of balanced forces when using either or both of the sets of cylinder assemblies for raising or lowering the top plate 40. A tubing tong unit 43 is mounted above the upper traveling slips 33 for rotating well tubing being handled by the snubber to perform cleanout and drilling operations in a well bore and for making and breaking joints between tubing sections. A work platform 44 is supported on a frame 45 secured by a mounting plate 50 with the stabilizing tube assembly 34. The work platform serves to support operating personnel for the snubber and normally is the location of the control panels, not shown, used in operating the snubber. The flange 35 on which the cylinder assemblies and the stabilizer tube assembly are mounted is supported on a lower fixed slip assembly frame 51 including a slip assembly 52 and a slip assembly 53 axially aligned with each other along a longitudinal axis extending coincident with the longitudinal axis of the stabilizing tube assembly and the well bore on which the system 30 is mounted. The fixed set of slips 52 are used to hold a tubing string being pushed into a well bore against well pressure while the upper slips 33 are cycling. The fixed slips 53, similarly, are employed while the upper slips are cycling for holding a tubing string being run into or pulled from the well bore when the weight of the string exceeds any force from the well bore pressure. A mast or gin pole 54 is mounted on a support member 55 secured with the frame 51 for handling well tubing lengths which must be lifted or lowered when making up a tubing string being run into a well bore with the snubber and when disassembling a string being pulled from the well bore by the snubber. The gin pole is a suitable, standard, hydraulically-extensible mast which has a top pulley 60 over which a line is run, not shown, for raising and lowering such tubing lengths.

In the operation of the snubber 30 for running tubing into a well, each length of tubing is raised by the gin pole 54 to a position above the rotary table 43 and lowered downwardly through the upper slips 33 into the stabilizing tube assembly 34. The hydraulic cylinder assemblies 41 and 42 are employed to raise the upper traveling slips 33 to grip the tubing near the upper end thereof. The upper traveling slips are then lowered by retracting the piston rods of the assemblies 41 and 42 forcing the tubing downwardly through the lowered fixed slips 52 and 53, through the blowout preventers, and into the well bore. When the hydraulic assemblies 41 and 42 are fully retracted, one of the fixed slips 52 or 53 is activated to grip the tubing to hold the tubing either against the weight of gravity or against the well pressure, depending upon operating conditions, while the upper traveling slips 33 are released from the tubing and raised to grip and force another increment of the tubing downwardly. The length of each increment of tubing depends upon the amount of extension provided in the cylinder assemblies. A plurality of lengths of tubing are connected in a conventional manner as the tubing string is made up and forced downwardly by the snubber.

In pulling a tubing string from a well bore, the string is sequentially engaged by the upper traveling slips at a lower end position of the slips and the slips are then raised by the hydraulic cylinders to lift the tubing string. During the downward cycling of the traveling slips 33, the appropriate lower fixed slips 52 or 53 are engaged with the tubing to hold it while the upper traveling slips move from an upper end to a lower end position to reengage and lift the tubing string.

In accordance with the invention, the system is provided with maximum stabilization by the stabilizing tube assembly 34, and the speeds of running the tubing string into the wellbore and pulling the string from the well bore are varied as desired by the selective operation of the hydraulic cylinder assemblies 41 and 42 which are operated either all together or in individual pairs and by the pressuring of one or both ends of the cylinders, depending upon the speed mode selected, as discussed in more detail hereinafter. The selectivity provided in the speed of operation of the system permits maximizing speed correlated with the weight and other operating conditions of the system.

During both snubbing and lifting operations, the weight of the tubing string being inserted or lifted varies as the length of the string increases and decreases. As the tubing string weight changes and as the relationship between the tubing string weight and the well pressure varies the vertical forces on the tubing handling system varies requiring changes in the operational speeds to match the handling capacity of the system with the weight requirements. The operator constantly monitors the weight of the tubing string varying the speed as needed. The weight capacities and speeds are inversely related. The maximum weight is handled at the lowest speed with the speed increasing to a maximum at the minimum weight capacity of the system. For example, as a tubing string is lifted it initially will be of maximum weight as it will be longest as it is initially started out of the well bore. As each joint is removed in pulling the tubing, the string becomes lighter. Thus, when the string is first started out of the hole, the system is operated at the speed which has the nearest capacity in excess of the weight of the string. As the tubing joints are removed to reduce the tubing string weight to the next smaller operating capacity, the system is shifted to the next higher speed. Thus, the system speed sequentially increases as the string weight decreases until the last tubing section may be pulled at maximum speed. The snubbing operation similarly correlates the weight on the system with speed of lowering the tubing string into the well.

Figure 2:
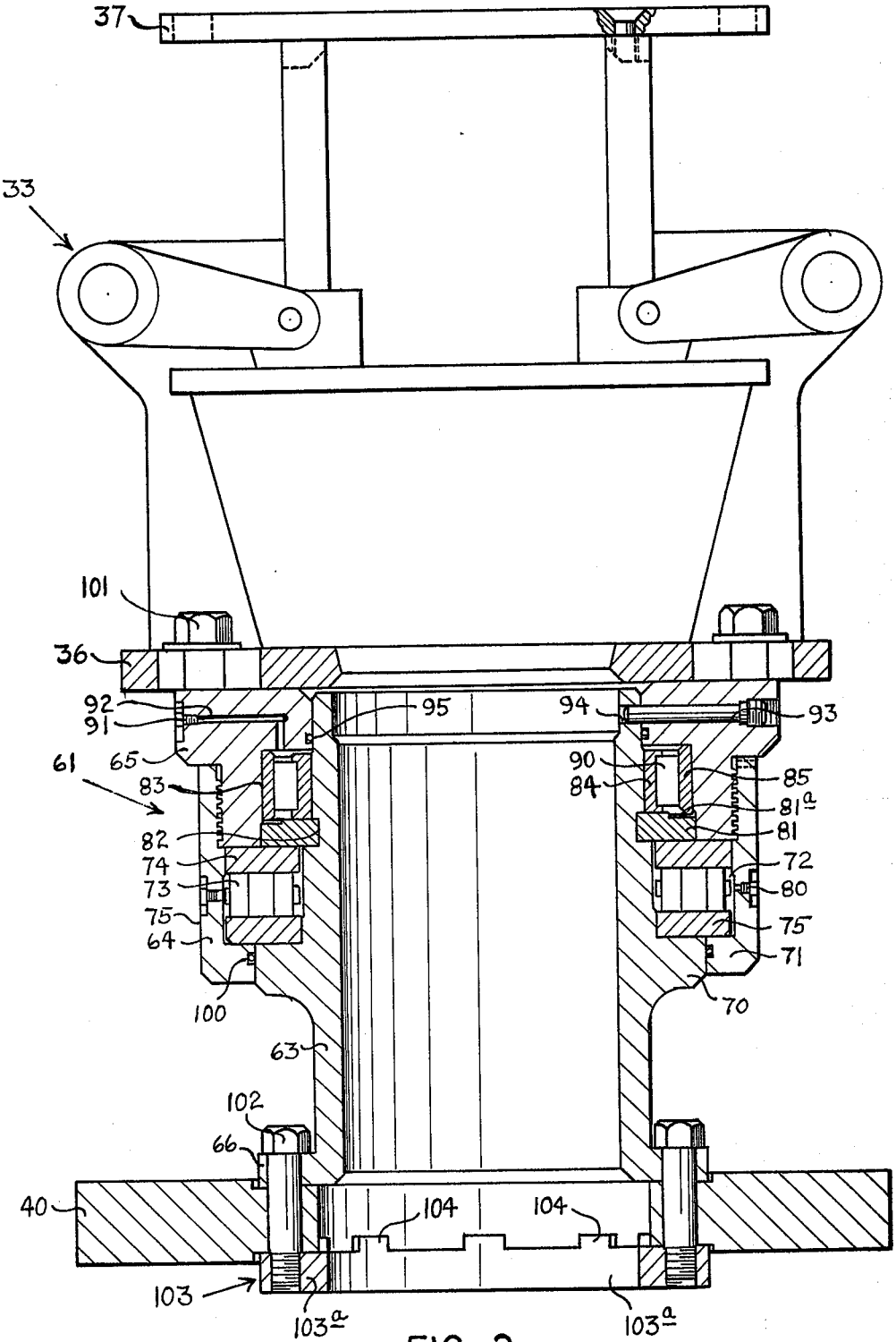
FIG. 2 is an enlarged longitudinal view in section and elevation of the swivel head and traveling slip bowl assembly mounted at the upper end of the stabilizing tube assembly of the device of the invention.

More specific details of the construction and mounting of the upper traveling slips 33 and the telescoping stabilizing tube assembly 34 are illustrated in FIGS. 2–11, inclusive. Referring particularly to FIG. 2, the upper traveling slip assembly 33 is mounted on a swivel bowl 61 which permits rotation of the upper slip assembly as it is raised and lowered. The upper traveling slip assembly 33 is constructed similar to the slip assemblies illustrated in U.S. Pat. No. 3,215,203, supra. In such reference patent, details of slip assemblies of the nature of the slip assembly 33 is the present invention are illustrated in FIGS. 8–11 and 15–18 of the reference patent. A preferred slip assembly of this type for use in the present invention is a commercially available unit referred to as an automatic tubing spider specifically identified as a CAVINS MODEL F. As discussed in some detail in the reference U.S. Pat. No. 3,215,203, the upper traveling slip assembly 33 is reversible so that it is adapted to force tubing downwardly into a well bore and for lifting the tubing from the well bore or supporting the tubing as it is lowered when the tubing is sufficiently heavy to move downwardly by its own weight. The slip assembly 33 has end mounting plates 36 and 37 for securing the traveling slip assembly allowing the assembly to be mounted in either position as needed. The swivel head 61 includes a tubular bearing mandrel 63, an annular collar 64, and an annular cap 65. The bearing mandrel 63 has an intermediate external annular flange 70 which cooperates with an internal annular flange 71 in the collar 64 to support a thrust bearing assembly 72 having a plurality of circumferentially-spaced roller bearings 73 operating on horizontal axes confined between upper and lower bearing plates 74 and 75. The collar 64 is provided with grease fittings 80 for injecting grease into the annular space between the collar and the bearing mandrel to lubricate the thrust bearing 72. A split bearing support ring 81 is disposed in an external annular recess 82 in the bearing mandrel 63 above the top bearing plate 74 of the thrust bearing 72. A roller bearing 83 is mounted between the bearing mandrel 63 and the cap 65 on the split ring 81. The roller bearing 83 includes an inner race 84, an outer race 85, and a plurality of circumferentially-spaced rollers 90 aligned on vertical axes for absorbing lateral loads. The split ring 81 has a top recessed portion **81*a* spaced from the lower end edge of the outer bearing race 85 to provide some tolerance between the bearing race and the split ring so that when the upper traveling slips 33 are loaded, the downward force absorbed by the thrust bearing 72 will not cause a binding between the bearing race 85 and the split ring 81. The cap 65 is provided with a grease fitting 91 leading to a lubricant passage 92 which communicates with the space between the cap 65 and the bearing mandrel 63 in which the roller bearing 83 is confined for lubricating the roller bearing. The cap 65 also is provided with a pair of circumferentially-spaced torque screws 93 which may be threaded inwardly to extend into corresponding holes 94 in the upper end portion of the bearing weld 63 to facilitate locking the cap 65 at a fixed position when making up the collar 64 on the cap in assembling the swivel head. A ring seal 95 disposed in an internal annular recess within the cap 65 seals between the cap and the bearing weld 63 above the roller bearing 83 to keep lubricant from leaking upwardly from the bearing. Similarly, a ring seal 100 in an internal annular recess within the flange 71 of the collar 64 seals between the lower end of the collar and the bearing weld 63 to prevent lubricant leakage from the lower thrust bearing 72. The torque screws 93 are retracted outwardly withdrawing the inner end portions of the torque screws from the holes 94 after the swivel head is assembled to permit free rotation of the upper traveling slips 33 on the swivel head. The traveling slip flange 36 is secured by circumferentially-spaced bolts 101 to the cap 65 mounting the traveling slips 33 on the slip bowl. In the reverse position of the slips 33, the flange 37 is secured to the cap 65 by the bolts 101. When the traveling slips rotate, as when drilling or cleaning out a well and the like, the cap 65, the outer race 85, the collar 64, and the upper thrust bearing race 74 turn while the bearing weld 63 remains fixed. The thrust bearing 72 supports vertical loads while lateral loads are taken by the roller bearing asembly 83 as the traveling slips rotate. The slip bowl 63 has a lower end flange 66 mounted secured to the top plate 40 by circumferentially-spaced bolts 102. As previously stated, the top plate 40 is supported on the upper ends of the piston rods of the hydraulic cylinder assemblies 41** and 42 for raising and lowering the top plate in manipulating well tubing with the upper traveling slips 33.

Referring to FIG. 2, the lower ends of the bolts 102 securing the bearing mandrel 63 on the top plate 40 are threaded along lower end portions into a split ring 103 formed by identical half-circular segments 103*a*. The split ring 103 is shown in further detail in FIGS. 10 and 11. The split ring segments have circumferentially-spaced holes 103*b* for the bolts 102 and also are provided with axially-extending lugs 104 circumferentially-spaced around the inner periphery of the split ring segments. The lock ring 103 is used to couple the inner splined tube 110 of the stabilizing tube assembly 34 with the top plate 40 so that as the top plate 40 is raised and lowered for moving the traveling slips 33 upwardly and downwardly, the splined tube 110 is raised and lowered for stabilizing the traveling slips and the hydraulic cylinder piston. The splined tube 110, as shown in detail in FIG. 6, has external upper end circumferentially-spaced locking slots 111 which are sized and positioned to receive the locking lugs 104 on the split lock ring 103. The splined tube has an external annular recess 112 spaced from the upper end of the tube to receive the split lock ring 103. The provision of the slots 111 around the upper end portion of the tube 110 defines a plurality of flange segments 113 above the recess 112. The bottom end edge of each of the flange segments 113 forms a downwardly facing stop shoulder 114. When the splined tube 110 is coupled with the top plate 40, the split ring 103 fits within the recess 112 around the tube aligned with the locking lugs 104 which project upwardly into the locking slots 111. The stop shoulder segments 114 on the bottoms of the flange segments 113 rest on the top face of the split ring 103 between the lugs 104 so that when the split ring is secured to the top plate 40 by the bolts 102 the splined tube is secured with the top plate and held against rotation by the lugs 104 fitting within the recesses 111. Raising and lowering the top plate 40 by means of the hydraulic cylinder assemblies 41 and 42, therefore, raises and lowers the splined tube 110.

Figure 7:
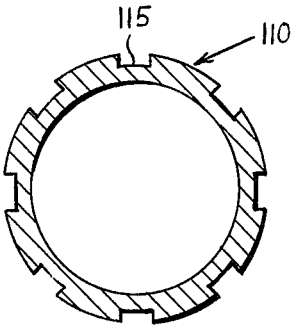
FIG. 7 is a view in section of the spline tube as seen along the line 7—7 of FIG. 6.
Figure 6:
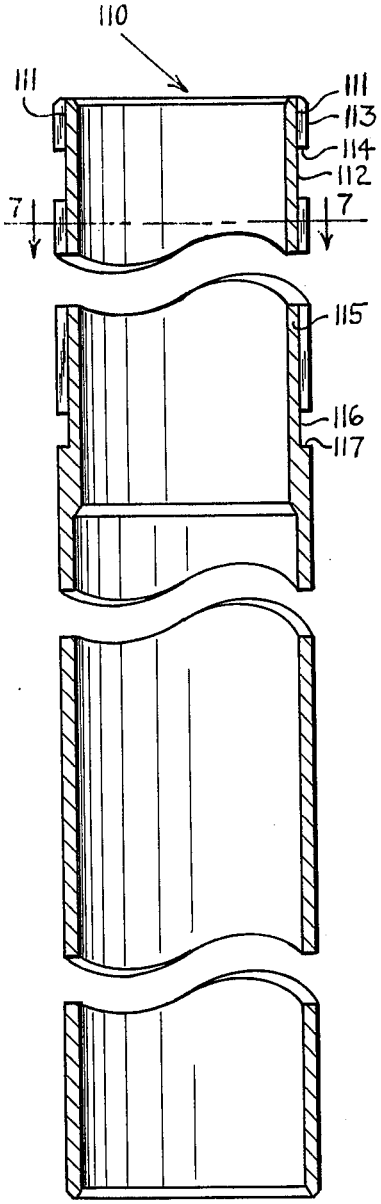
FIG. 6 is a broken longitudinal view in section of the upper inner spline tube of the stabilizing tube assembly.
Figure 8:
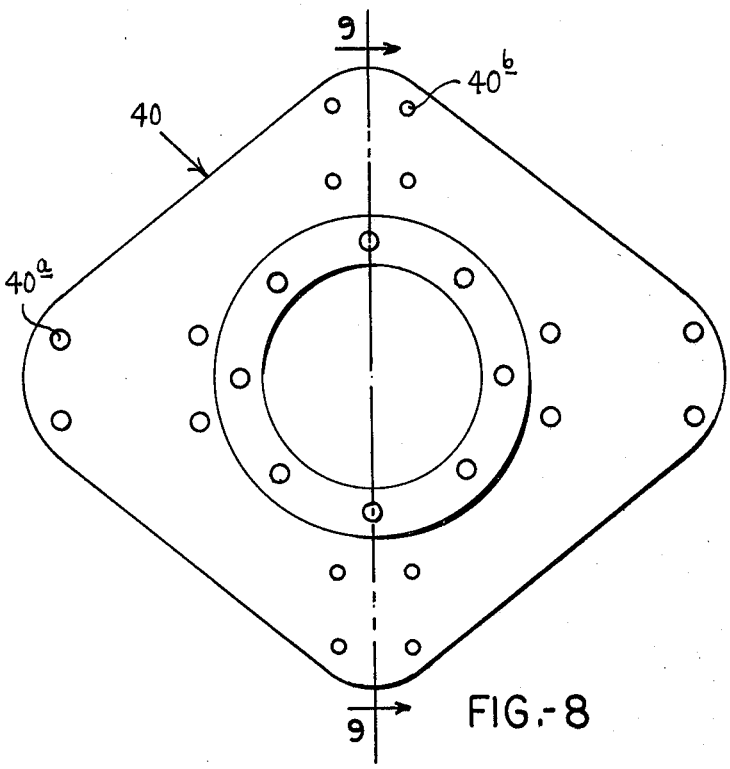
FIG. 8 is a top plan view of the top plate secured to the upper ends of the piston rods of the piston and cylinder assemblies for supporting the upper traveling slip assembly.
Figure 9:
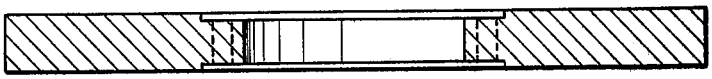
FIG. 9 is a view in section along the line 9—9 of FIG. 8.
Figure 10:
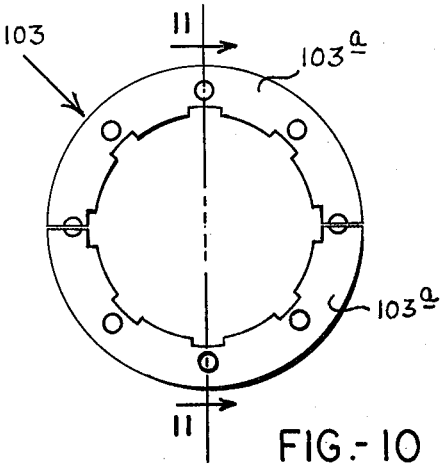
FIG. 10 is a top plan view of the split lock ring used for locking the upper end of the spline tube of FIG. 6 with the top plate of FIGS. 8 and 9.
Figure 11:
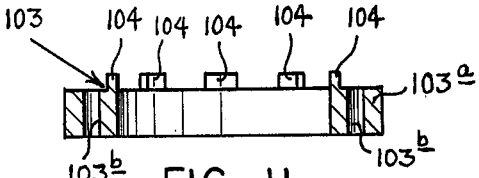
FIG. 11 is a view in section along the line 11—11 of FIG. 10.
Figure 12:
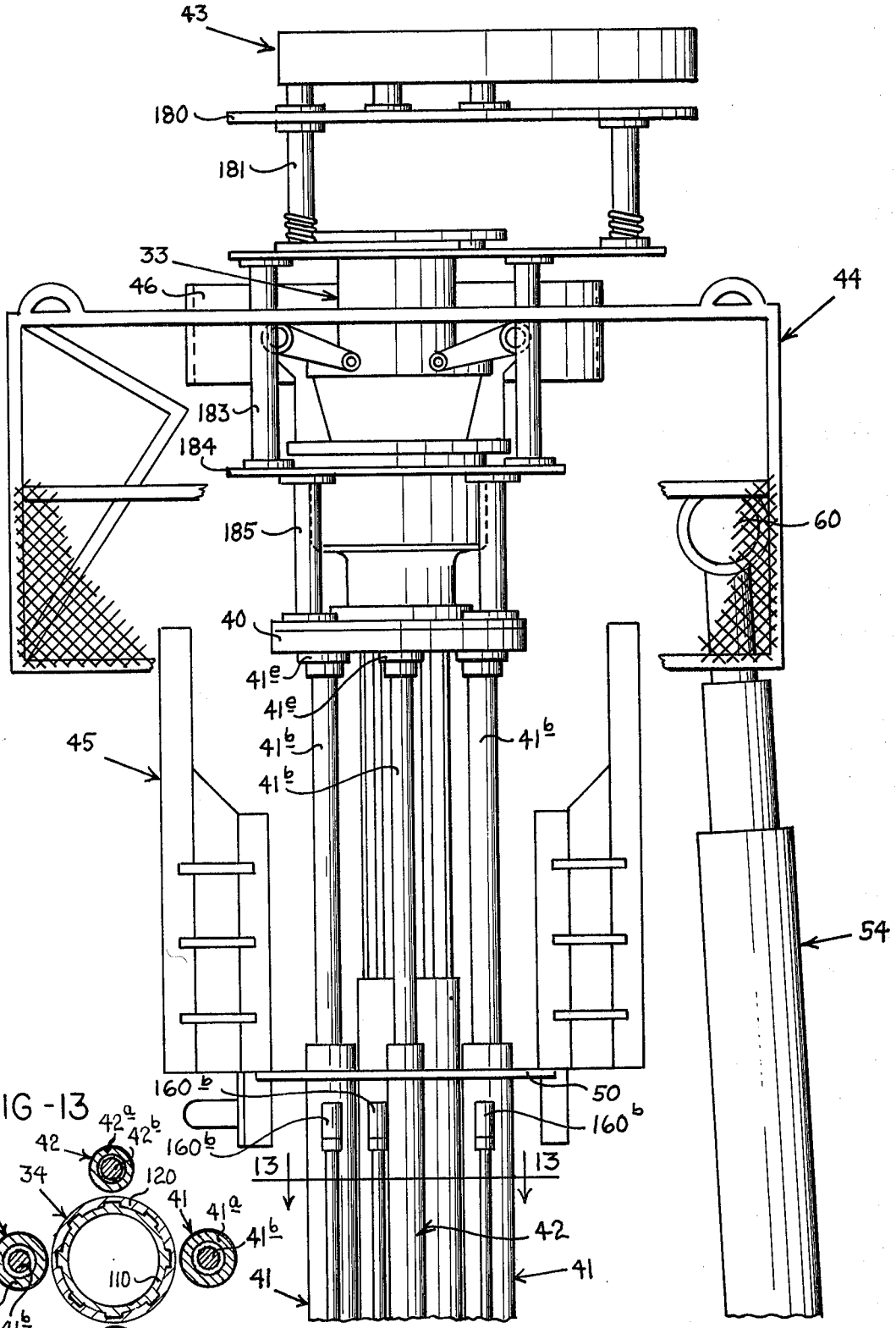
FIG. 12 is a fragmentary side view in longitudinal elevation of a portion of the system illustrated in FIG. 1A showing the cylinder assemblies partially extended raising the upper traveling slip assembly.

The outside diameter of the splined tube 110 is sized to form a slip fit within the outer fixed tube 120 into which the splined tube telescopes forming the stabilizing tube assembly 34. The splined tube 110 is provided with external longitudinally-extending circumferentially-spaced guide slots or recesses 115 which extend from the recess 112 to a bottom recess 116 defined below the slots 115 above a stop shoulder 117. The circumferential spacing of the guide slots 115 is illustrated in FIG. 7. The length of the guide slots 115 is determined by the stroke of the inner tube 110 within the outer tube 120 which, of course, is controlled by the maximum extension of the piston rods of the cylinder assemblies 41 and 42. The guide slots 115 are spaced and sized to receive splines 121 on a spline ring 122 secured into the upper end portion of the outer tube 120 of the stabilizing tube assembly. The inside diameter of the spline ring 122 between the splines 121 is equal to the inside diameter of the tube 120 below the spline ring to form a close sliding fit with the outside diameter of the inner tube 110 between the guide slots 115. The outer diameter of the spline ring is reduced along the lower end portion of the ring to receive an upwardly extending flange 123 on the outer tube 120. The spline ring and the outer tube 120 are externally slotted to receive a strip of keystock 124 for proper orientation of the spline ring in the outer tube for purposes which will be discussed in more detail hereinafter. As indicated along the left hand side of FIG. 3 on the elevation portion of the drawing, the spline ring 122 is circumferentially welded at 125 to the outer tube 120. Spaced below the spling ring, the tube 120 is provided with circumferentially-spaced bores 130. An upwardly facing stop shoulder 131 is provided on a flange 132 formed around the tube 120 below the bores 130.

The inner tube 110 telescopes in sliding relation into the outer tube 120 with the splines 121 of the spline ring 122 engaged in the longitudinal guide slots 115 along the inner tube. Thus, the inner tube moves in the outer tube between an upper end position limited by the maximum extension of the piston rods of the hydraulic cylinders 41 and 42 and a lower end position at which the split ring 103 rests on the top of the outer tube on the upper end edge of the spline ring 122. The telescoping relationship of the inner and outer tubes of the stabilizers tube assembly 34 stabilizes the well servicing system 30 as the upper traveling slips are raised and lowered by the cylinder assemblies permitting longer travel increments than available in prior art units.

Figures 3, 4, 5:
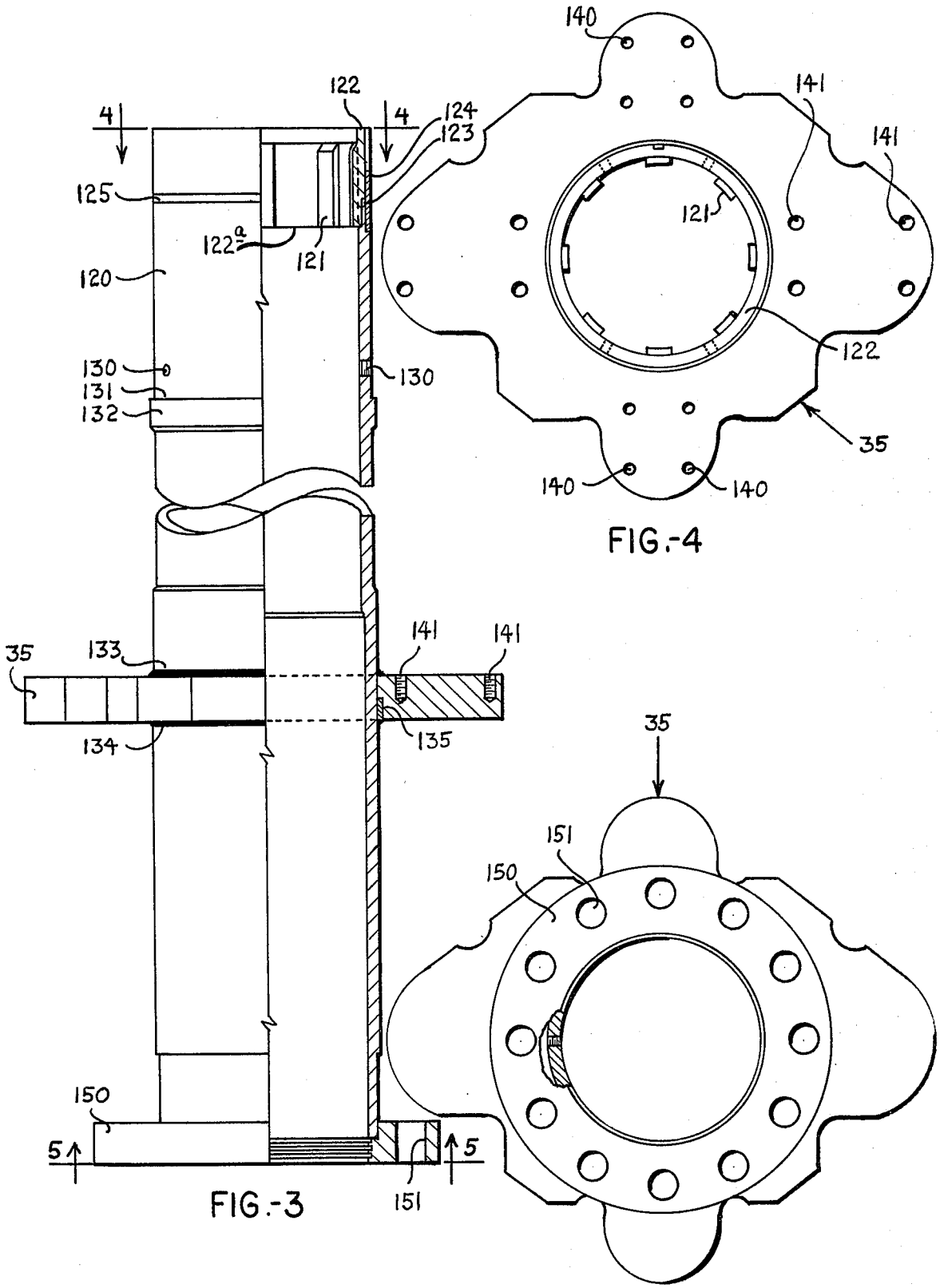
FIG. 3 is a broken longitudinal view in section and elevation of the lower outer tube of the stabilizing tube assembly of the device.
FIG. 4 is a top view of the tube assembly of FIG. 3 as seen along the line 4—4 of FIG. 3 showing the base plate on which the piston and cylinder assemblies are mounted.
FIG. 5 is a bottom view partially in section of the tube assembly of FIG. 3 as seen along the line 5—5 of FIG. 3 showing the bottom face of a flange for mounting the system on the wellhead and the bottom face of the base plate seen in FIG. 4.

The base plate 35, as shown in FIG. 3, is secured by welding at 133 and 134 to the outer tube 120 at a location spaced above the lower end of the outer tube to support the bottom ends of the hydraulic cylinder assemblies 41 and 42. A strip of keystock 135 is secured on the outer face of the outer tube to fit a slot provided within the bottom plate 35 to properly orient the bottom plate on the outer tube. The orientation slots and the keystock 123 at the spline ring 122 along with the keystock 135 fitted into the bottom plate 35 all must be properly located to correctly orient the spline ring, the outer tube, and the bottom plate so that the various parts of the assembly will be properly positioned to maintain vertical alignment of the cylinder assemblies 41 and 42 vertical as the piston rods of the assemblies extend and retract during the raising and lowering of the traveling slip assembly 33. The bottom plate 35 is shown in elevation in FIG. 4 which also shows a top view of the spline ring 122. The bottom plate 35 is provided with sets of vertical bolt holes 140 arranged to secure the base ends of the cylinders of the assemblies 41 and 42. A mounting flange 150 is threaded on and welded to the lower end of the outer tube 120 for mounting the outer tube on the lower slip assembly frame 51 as shown in FIG. 1B. The flange 150 is provided with circumferentially-spaced bolt holes 151 used for securing the flange to the frame.

As illustrated in FIGS. 1A and 1B, the cylinder assemblies 41 and 42 are mounted between the bottom plate 35, plate 50 and the top plate 40 for supporting and raising and lowering the top plate. Each of the large cylinder assemblies 41 includes a hollow cylinder 41*a* and a piston rod 41*b* provided on a lower end with a piston head 41*c*, FIGS. 14 and 15. Each of the cylinders 41*a* has a base flange 41*d* secured to the base plate 35 as shown in FIG. 1B. Bolts, not shown, are connected through the cylinder base flange into the mounting base plate holes 141. Similarly, the upper end of each piston rod 41*b* is provided with a flange 41*e* provided with holes, not shown, which are used for bolts, not shown, for connection with bolt holes 40*a* in the top flange 40, shown in FIG. 8. Similarly, each of the smaller cylinder assemblies 42 includes a hollow cylinder 42*a* and a piston 42*b* provided with a piston head 42*c* on the lower end thereof as illustrated schematically in FIGS. 14 and 15. The base ends of the cylinders 42*a* each is provided with a mounting flange 42*d* for connection with the base plate 35 by means of bolts, not shown, secured into the bolt holes 140, FIG. 4, of the base plate. The upper ends of the piston rods 42*b* are each provided with a flange 42*e* secured with the bottom face of the top plate 40 by means of bolts, not shown, engaged in the bolt holes 40*b* of the top plate, FIG. 8. Both of the cylinder assemblies 41 and 42 are conventional double-acting hydraulic units designed for introduction of hydraulic power fluid into each end of the cylinder so that the piston rod may be both extended and also retracted by applying hydraulic pressure since it is necessary that the upper traveling slips be capable of being lowered and raised by a positive force for forcing well tubing into a well under pressure and for lifting the well tubing from the well. As shown in FIG. 1B, a hydraulic fluid manifold assembly is clustered around the base end of the stabilizer tube assembly below the bottom plate 35 for supplying hydraulic power fluid to and returning the fluid from both ends of the two sets of cylinder assemblies 41 and 42. The complete connections of the manifold assembly with the hydraulic cylinder assemblies are illustrated schematically in FIGS. 14 and 15. All of such connections are not specifically shown in FIG. 1B to simplify the Figure, though it is to be understood that they include conventional hydraulic fluid lines, couplings, and the like. Looking specifically at the structure illustrated in FIG. 1B and FIG. 1A, a hydraulic power fluid conduit network 160 supplies hydraulic fluid to the upper piston rod ends of the large hydraulic cylinders 41 through branch lines 160*a*, each of which connects into the side of the cylinders 41*a* near the upper ends thereof through fittings 160*b*, FIG. 1A. Similarly, hydraulic power fluid is supplied to the small set of hydraulic cylinders 42 through a fluid conduit network 161 which includes branch lines 161*a* connecting into the upper ends of the cylinders 42*a* through fittings 161*b* as seen in FIG. 1A. The hydraulic power fluid is similarly connected into the lower head ends of the cylinders of the assemblies 41 and 42 by lines, not shown, leading from the manifold system to the lower ends of the cylinders below the pistons within the cylinders. As seen in the schematic diagrams 14 and 15, the hydraulic fluid is supplied to the lower ends of the large assemblies 41 through line 162 having branch lines leading into the lower ends of the cylinders 41*a*. Similarly, the lower ends of the small cylinders 42*a* are supplied with hydraulic fluid through a line 163 having branch lines connected into the lower ends of the cylinders 42*a* below the pistons 42*c*.

The mounting flange 150 on the base end of the outer tube 120 is secured to a flange 170 of the lower slip assembly frame 51. The flange 170 is supported on stanchions 171 secured with a lower plate 172 of the lower slip assembly. The lower fixed slip assemblies 52 and 53 are secured with the plates 170 and 172, respectively, of the lower slip assembly frame 51 as seen in FIG. 1B.

Referring to FIG. 1A, the tubing tongs unit 43 is supported on a plate 180 secured on stanchions 181 mounted on a plate 182 connected on stanchions 183 which are mounted on a plate 184 resting on stanchions 185 secured to the top plate 40. The plates 182 and 184 are formed with suitable openings, not shown, and the stanchions supporting such plates are located so that the plates fit around the swivel bowl 62, and the upper traveling slips 33. Such mounting plates and stanchions are suitably secured together by nuts and bolts and the like and other standard fittings, not shown, to support the tongs unit 43 from the top plate 40 above the upper traveling slips 33 so that the tongs unit is raised and lowered with the traveling slips to rotate well tubing and the like gripped by the traveling slips and being run into or pulled from a well bore. The tongs unit is a suitable standard commercially available unit manufactured by Eckel Manufacturing Company having means for gripping and rotating pipe and the like.

The work platform or bracket 44 is supported from the vertical frame assembly 45 which includes support members 45*a* secured with the plate 50. A safety guard ring 46 is mounted within the framework 45 spaced around the upper traveling slips and the supporting stanchions 183. Suitable control panels, not shown except schematically in FIG. 14 and 15, for operating the hydraulic and other control systems of the snubber are mounted on the platform 44 which includes adequate space for one or more operators. The platform 44 remains fixed as illustrated while the tongs 43 and the upper traveling slips 33 along with the supporting structure mounted on the upper ends of the piston rods on the top plate 40 are raised and lowered by the hydraulic cylinder assemblies 41 and 42. The upper slips 33 grip a tubing string to raise or lower the string. The lower slips 52 and 53 are used for supporting the tubing string while connections are made and while the upper slips are released from the string to cycle between the upper and lower positions of the slips. The upper slips are reversible so that force may be applied either upwardly or downwardly. The selection of the lower slips 52 or 53 depends upon whether the tubing is being supported against an upward force as when tubing is forced into the well against well pressure exceeding tubing weight or the tubing weight exceeds any upward force on the tubing either during snubbing or pulling.

Figure 14:
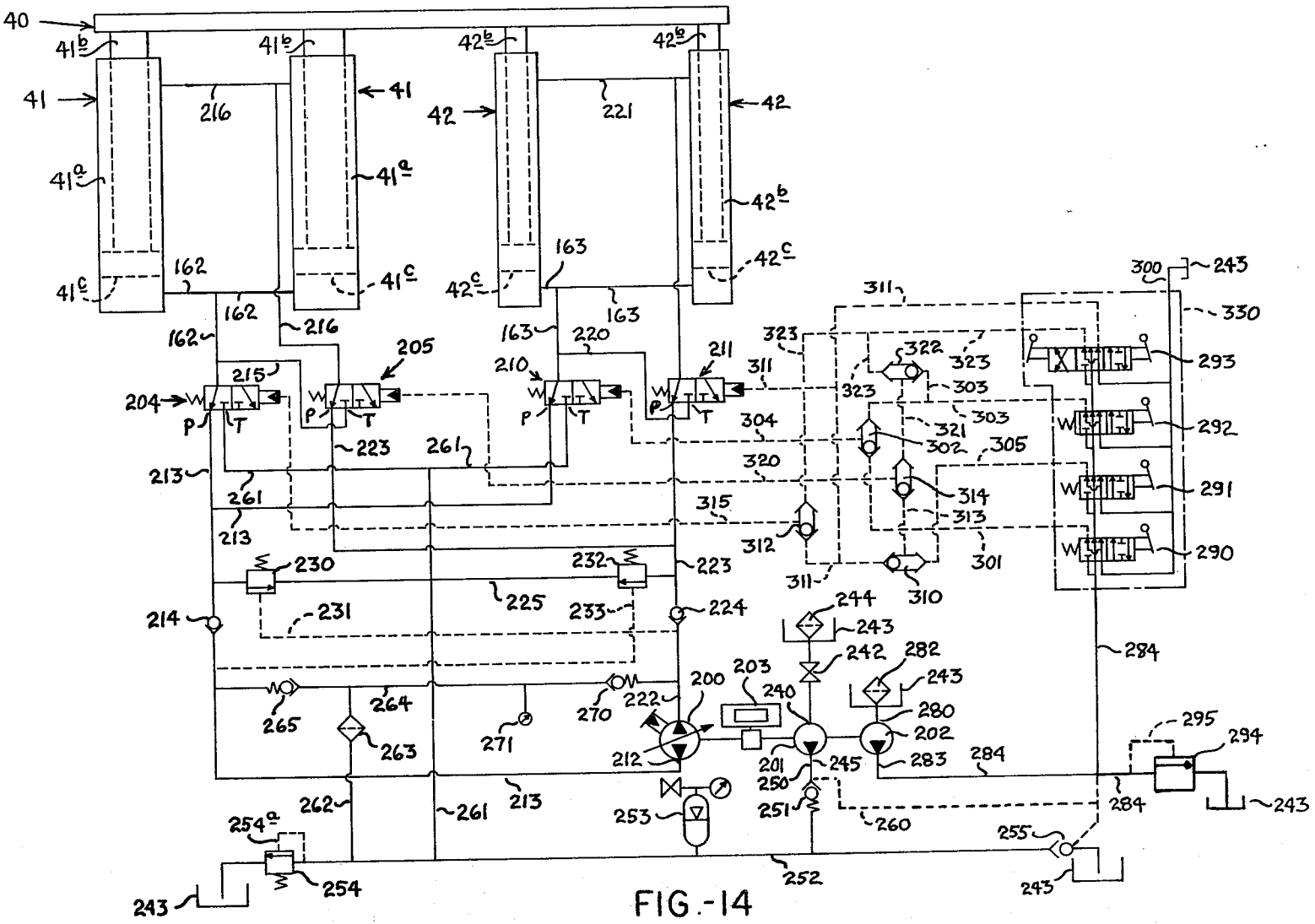
FIG. 14 is a schematic view of a preferred form of hydraulic system for operating and controlling the system of the invention over a range of five lift speeds and two snubbing speeds.

FIG. 14 represents in schematic form a preferred hydraulic power and control fluids system for operating the well tubing handling unit 30 over a range of five lift speeds for raising tubing out of a well bore and two snubbing speeds for inserting well tubing into a well bore. The system illustrated in FIG. 14 is used for extending and retracting the piston rods of the cylinder assemblies 41 and 42 for raising and lowering the plate 40 on which the upper traveling slips 33 are supported. Hydraulic pressure is provided for driving the piston assemblies to control the lift and snubbing speeds by a variable displacement pump 200 and fixed displacement pumps 201 and 202 which are driven by an engine 203. The variable displacement 200 is preferrably a VARIACS hydraulic pump manufactured and distributed by Variacs Pump Division of Otis Engineering Corporation. The fixed displacement pumps may be any suitable standard pumps capable of delivering the desired hydraulic pressure. The pump 201 must be capable of maintaining the portion of the system supplied by it at a pressure of at least 1,000 psi. The variable displacement pump 200 supplies the hydraulic pressure for extending and retracting the piston rods of the cylinder assemblies 41 and 42. The pump 201 supplies accumulator pressure and pressure on the return sides of the cylinder assemblies 41 and 42 and the intake port of the pump 200 to prevent cavitation and related problems. The pump 200 is a reversible-type pump capable of pumping in either of two directions so that it may discharge and intake fluid as desired from either of its ports in order to pump hydraulic fluid to either ends of the cylinders of the assemblies 41 and 42 for both pulling and snubbing.

The hydraulic power fluid system, shown in FIG. 14 includes two-position, three-way directional power fluid valves 204, 205, 210, and 211 for directing hydraulic power fluid to the cylinder assemblies 41 and 42. The valves 204 and 205 control hydraulic fluid flow to the cylinder assemblies 41 during both lifting and snubbing modes of operation. The valves 210 and 211 control hydraulic fluid flow to the cylinder assemblies 42 during lifting and snubbing. The pump 200 has a first port 212 through which the hydraulic power fluid is discharged during the pulling modes of operation. The pump 212 is connected with the valves 204 and 210 by lines 213 which include a check valve 214. The valve 204 is connected with the piston ends of both of the cylinders 41*a* by lines 162 for supplying hydraulic fluid for lifting. A line 215 connects from the line 162 to the valve 205 which is connected to the rod ends of the units 41 by a line 216 for supplying hydraulic lift fluid through the valve 205 to the rod ends of the cylinders 41*a* for operating the cylinder assemblies 41 in the regenerative mode at which times power fluid is supplied to both ends of the units and also when the cylinder assemblies are free floating on the return side of the pump 200. Similarly, the lines 163 connect the valve 210 with the piston ends of the cylinders 42 for supplying hydraulic fluid to the assemblies 42 during a lifting mode of operation. A line 220 connects the line 163 with the valve 211 which connects with the rod ends of the cylinders 42*a* by a line 221 for interconnecting the rod and piston ends of the cylinder assemblies 42 when the units are operated in the regenerative lift cycle and also when free floating.

The other port 222 of the hydraulic power fluid pump 200 is connected by lines 223 to the valves 205 and 211. The lines 223 include a check valve 224. The lines 223 serve return fluid functions and also permit the pump 200 to supply hydraulic power fluid through the valves 205 and 211 to the rod ends of the cylinder assemblies 41 and 42 for snubbing operations. The lines 223 between the valves 205 and 211 and the check valve 224 serve as return lines. The lines 213 and 223 are connected together by a line 225 which connects into the line 213 between the valves 204 and 210 and the check valve 214 and connects into the line 223 between the valves 205 and 211 and the check valve 224. The line 225 includes one counter-balance and holding valve 230 which communicates with a pilot pressure line 231 leading to the line 223 between the pump port 222 and the check valve 224. The line 225 also includes another counter-balance and holding valve 232 which communicates through a pilot pressure line 233 with the line 213 between the pump port 212 and the check valve 214.

The pump 201 has an intake port 240 connected with a line 241 containing a valve 242 and leading to the hydraulic fluid reservoir 243 through a filter 244. The pump 201 has a discharge port 245 communicating with a line 250 which connects through a check valve 251 with a line 252 leading to an accumulator 253 and to the reservoir 243 through a pressure relief valve 254 and a drain valve 255. The drain valve 255 communicates through a pressure-sensing pilot line 260 with the line 250 between the pump 201 and the check valve 251. The line 252 also connects with a line 261 which leads to the valves 204 and 210 and to the line 225 between the valves 230 and 232. A line 262 including a filter 263 connects from the line 252 to a line 264 extending between the lines 213 and 223. The line 264 connects into the line 213 between the check valve 214 and the pump port 212 of the pump 200. The line 264 connects into the line 223 between the pump port 222 of the pump 200 and the check valve 224. The line 264 includes check valves 265 and 270 located on opposite sides of the connections to the line 262 and a pressure guage 271. The accumulator 253 supplies additional hydraulic fluid into the system through the lines 252, 262, and 264 selectively into the lines 213 and 223 through the check valves 265 or 270, respectively, as required by the operation such, for example, as when the return fluid from the rod ends of the assemblies 41 and/or 42 is less than the fluid required in the piston ends of the assemblies when lifting a tubing string. The relief valve 254 permits discharge back to the reservoir 243 when the pressure in the line 252 exceeds a predetermined value as sensed through the line 254*a* which is a pilot pressure line from the relief valve into the line 252. The drain valve 255 allows the hydraulic fluid in the accumulator 253 to drain through the line 252 back into the reservoir 243 when the pressure as sensed through the line 260 in the line 250 drops below a predetermined level such as when the system is shut down.

The pump 202 which supplies high pressure hydraulic fluid to the control system has an intake port 280 connected with the line 281 communicating through a filter 282 with the reservoir 243. The pump 202 has a discharge port 283 connected with the line 284 which leads to a series of control valves 290, 291, 292, and 293 which control the operation of the power fluid valves 204, 205, 210, and 211. A pressure relief valve 294 is connected with the line 284 to discharge hydraulic fluid to the reservoir 243 responsive to a predetermined high pressure sensed through a pilot line 295 connected from the relief valve into the line 284. The control valves 290, 291, and 292 are each two-position, manual, directional control valves. The valve 293 is a three-position, manual directional control valve. A drain line 300 is connected from all of the control valves 290 – 293, inclusive, to the reservoir 243. The valves 290 – 293, inclusive, are individually operable to control the flow of hydraulic power fluid through the valves 204, 205, 210, and 211 to and from the cylinder assemblies 41 and 42.

Referring to FIG. 14, the control valves 290 communicates through a pilot line 301 with a shuttle valve 302 which also is connected by a pilot line 303 with the control valve 292. The shuttle valve 302 communicates through a pilot line 304 with the power fluid valve 210. The control valve 291 is connected through a pilot line 305 with a shuttle valve 310 which is connected by pilot lines 311 with another shuttle valve 312 and with the control valve 293 and the power fluid valve 211. The shuttle valve 310 is also connected by pilot line 313 with a shuttle valve 314. The shuttle valve 312 is connected by pilot line 315 with the power fluid valve 204. The shuttle valve 314 is connected by pilot line 320 with the power fluid valve 205 and by a pilot line 321 with another shuttle valve 322 which is also connected into the pilot line 303. The control valve 293 connects through pilot lines 323 with both the shuttle valve 312 and the shuttle valve 322.

The control valves 290, 291, 292, and 293 are conveniently located on a panel represented by the broken line 330 which is preferably mounted on the working platform 44 so that the several pulling and snubbing functions of the system may be controlled by an operator on the platform by manipulation of the control valves. The control valves are used either singularly or in combination to properly direct the pilot fluid to actuate the power fluid valves 204, 205, 210, and 211, as required for each selected speed or operation of the system when pulling and when snubbing. When the control valve 290 is operated, pilot pressure is admitted from the pump 202 through the pilot line 301 to the shuttle valve 302 which is shifted to the opposite end position from that shown in FIG. 14 to admit the pilot pressure to the line 304 for actuating the valve 210. When the control valve 291 is operated, pilot pressure is admitted to the pilot line 305 positioning the shuttle valve 310 as shown in FIG. 14 admitting the pilot pressure through the line 313 into the shuttle valve 314 which is shifted to the opposite end position from that shown in FIG. 14 so that the pilot pressure is communicated through the line 320 to actuate the valve 205. When the control valve 292 is operated, pilot pressure in the line 303 is applied to the shuttle valve 302 positioning the valve as shown in FIG. 14 to communicate the pilot pressure through the line 304 to actuate the valve 210; and the pilot pressure is also applied into the shuttle valve 322 which is shifted from the position shown in FIG. 14 to the opposite end position applying the pilot pressure through the line 321 into the shuttle valve 314 which is positioned as shown in FIG. 14 to apply the pilot pressure through the line 320 to actuate the valve 205. Each of the control valves 290 - 293, inclusive, has a normal first position at which no pilot pressure is applied from the particular valve to the power fluid valves 204, 205, 210, and 211. Each of the valves 204, 205, 210, and 211 has a normal first position to which each valve is biased by a spring and at which flow occurs along a first path through the valve. When a control valve connected with one of the power fluid valves is operated, the control valve communicates a pilot pressure to the power fluid valve which shifts to a second position of the valve for directing hydraulic power fluid through the power fluid valve along a second flow path.

The control valve 293 is a three-position valve which, at a first position, does not communicate pilot pressure to either of the lines 311 or 323, while at the other positions communicates pilot pressure to one or the other of the lines 311 or 323. When the control valve 293 is operated to pressure the pilot line 323, the pilot pressure is applied to both of the shuttle valves 312 and 322. The pressure applied to the shuttle valve 312 positions the valve as shown in FIG. 14 to apply the pilot pressure through the line 315 to actuate the valve 204. The pilot pressure in the line 323 also enters the shuttle valve 322 positioning the valve as shown in FIG. 14 applying the pilot pressure through line 321 to the shuttle valve 314 which is positioned as in FIG. 14 to apply the pilot pressure through the line 320 to actuate the valve 205. When the control valve 293 is positioned to supply pilot pressure to the line 311, the pressure is applied into the shuttle valves 310 and 312. The pressure applied into the shuttle valve 310 is communicated through the line 313 to the shuttle valve 314 which is shifted upwardly from the position of FIG. 14 to apply the pressure through the pilot line 320 to actuate the valve 205. The pilot pressure applied from the line 311 into the shuttle valve 312 shifts the shuttle valve upwardly from the position of FIG. 14 to apply the pilot pressure through the line 315 to actuate the power fluid valve 204.

Each of the hydraulic power fluid valves 204, 205, 210, and 211 has ports connected with the supply and return portions of the system which, by definition, are a port P and a port T. In the embodiment of the system represented in FIG. 14, the normal, unactuated position of the valves 204, 205, and 210, the valves communicate with the pressure port P. The normal, unactuated position of the valve 211 is with the valve communicating with the port T. With such normal power fluid valve settings, the valves are arranged such that the valves 204, 205, and 210 permit through flow to or from the port P while the valve 211 permits through flow in the unactuated position to and from the port T.

The preferred operational modes of the embodiment of the system illustrated in FIG. 14 includes five lift speeds and two snubbing speeds. Fundamentally, the operation of the system is predicated upon the employment of a maximum, constant output of the power pump 200 with the variations in both the lift speeds and the snubbing speeds being obtained through manipulation of the several control and power fluid valves to selectively direct the hydraulic power fluid to one or both ends of either of or both of the sets of cylinder assemblies 41 and 42 so that a maximum speed is obtained at each setting consistent with the force required to handle the weight of the tubing string and related equipment and the well pressures encountered during operations. It will be understood that lift speeds refer to those speeds which are employed in raising or pulling a string of tubing from a well bore while snubbing speeds are those speeds used in running a tubing string into a well bore. During both lifting and snubbing, any formation pressure in the well bore acts upwardly on the tubing string tending to lift the string. Thus, under certain conditions in snubbing, it is necessary to force the tubing down into the well bore against the well pressure. By use of at least two pairs of different size cylinder assemblies, selective combinations of one or both ends of the assemblies and one or both of the pairs of assemblies are avaiable to provide a substantially enlarged variety of snubbing and lift speeds in comparison with the prior art. The weight handling capacity decreases in substantially equal increments as the speed of operation increases.

It will be apparent that, in operating the handling system, the hydraulic lines of both the control and power portions of the system must be liquid full in order for the system to function. Also, the accumulator 253 which functions in the normal manner as a surge tank must contain hydraulic power fluid to flow back into the system as needed. The control portions of the system, including the valves 290 - 293, inclusive, together with the pilot lines associated therewith, are supplied by the pump 202 which pump hydraulic fluid from the reservoir 243. Similarly, the accumulator 253 and the lines associated with the accumulator on the return side of the units 41 and 42 are supplied with fluid from the reservoir 243 by the pump 201. The entire power portion of the system is filled with hydraulic power fluid by the pump 201. The pump 200 is the power source which circulates the hydraulic power fluid to and from the units 41 and 42 but does not directly intake power fluid from the reservoir but rather obtains make up power fluid from the accumulator 253.

The first lift speed of the handling system is by definition the lowest speed which lifts the maximum weight for which the system is designed. At such lift speed, the control valves 290 - 293 are in normal positions at which there is no pilot pressure communicated from the control valves to the power fluid valves 204, 205, 210, and 211. The power fluid valves 204, 205, 210, and 211 are, thus, unactuated at the previously described normal positions at which the valves 204, 205, and 210 open to the P ports of the valves while the valve 211 communicates with the T port. The pump 200 discharges hydraulic power fluid through the port 212 into the line 213. The power fluid flows through the line 213 through the check valve 214 to the power fluid valves 204 and 210. The power fluid enters the port P of the valve 204 and flows through the valve, into the lines 162 on the discharge side of the valve 204 through which the power fluid flows into the lower piston ends of the cylinder assemblies 41. The power fluid pressure is also applied in the line 215 leading from the lines 162 to the valve 205, but since the normal position of the valve 205 is in communication with the port P and the line 215 leads to the port T of the valve 205, no flow occurs through the line 215. The power fluid pressure in the assemblies 41 below the pistons **41*c* provides a lifting force to extend the rods 41*b*. The same power fluid pressure applied through the line 213 to the valve 210 enters the port P of the valve 210 and is communicated through the valve into the lines 163 and 220. The pressure in the lines 163 applies power fluid pressure in the piston ends of the assemblies 42 below the pistons 42*c*. The power fluid in the line 163 flows in the line 220 to the port T of the valve 211 from which the power fluid is communicated through the valve 211 to the lines 221 leading to the rod ends of the cylinder assemblies 42 so that power fluid pressure also is applied above the piston heads 42*c*. With power fluid pressure being applied in the cylinder assemblies 42 above and below the pistons 42*c*, the effect of the pressure is a net lifting force applied on the lower face of the pistons over an effective area equal to the difference between the cylinder area below the piston and the annular area in the cylinder above the piston around the piston rod which is equal to the cross sectional area of the piston rod. This manner of operation of the cylinder assemblies 42 wherein power fluid pressure is introduced into both ends of the cylinder and the piston is lifted due to the difference in the effective areas over which the fluid pressure is applied is known as a "regenerative" method. Thus, the assemblies 41 provide a lifting force due to the application of the power fluid pressure over the faces of the pistons 41*c* while the assemblies 42 provide a lifting force in the regenerative mode due to the fluid pressure over an effective area equal to the diameter of the piston rods 42*b*. The combined upward forces on the cylinder assemblies 41 and 42 lift the plate 40 supporting the traveling slips 33**.

As the pistons and piston rods of the cylinder assemblies 41 move upwardly, the power fluid in the cylinders above the pistons **41*c* around the piston rods is displaced into the lines 216 through which the return fluid flows to the valve 205. The fluid flows through the valve 205 to the port P where the fluid enters the line 223. The return fluid in the line 223 cannot flow through the check valve 224 nor can the fluid flow in the line 223 through the valve 211 because at the present normal position of the valve 211 it communicates with the port T; and, thus, the line 223 effectively deadends at the valve 211. The high pressure power fluid in the line 213 is sensed in the pilot line 233 leading to the counter-balance valve 232 which is opened by the power fluid pressure permitting the return fluid in the line 223 to flow through the counter-balance valve 232 into the line 225 through which the fluid flows to the lines 261. The return fluid in the line 225 cannot flow through the closed counter-balance valve 230 because the pilot line 231 to the counter-balance valve 230 is sensing a low pressure on the return side of the pump 200. The return fluid in the line 261 flows from the line 261 to the line 252 through which the return fluid flows to the line 262. The return fluid in the line 262 flows through the filter 263 into the line 264 which communicates with both the check valve 265 and the check valve 270. Since the power fluid pressure is on the other side of the check valve 265, the return fluid in the line 264 does not flow through the check valve 265 but rather flows through the check valve 270 to the return port 222 of the pump 200. The volume of the fluid returns from above the pistons in the assemblies 41 is less than the amount of power fluid required to be supplied to the cylinders below the pistons during the lifting procedure; and, thus, such difference must be made up into the intake port 222 of the pump 200. This make-up power fluid is drawn from the accumulator 253 into the line 252 through which it flows to the line 262 and through the check valve 270 into the intake port 222 so that sufficient fluid passes into the intake port for the pump to discharge it through the discharge port 212 and through the previously described path into the cylinder assemblies 41 below the pistons 41*c***.

Referring now to the units 42, it has been previously indicated that the power fluid is simultaneously applied from the line 213 through the valves 210 and 211 into the cylinder assemblies 42 both below the pistons **42*c* and above the pistons around the piston rods, with the net lifting effect being provided due to the fact that the fluid is applied over the entire piston head below the pistons and only in the annular space above the pistons around the piston rods. As the pistons and rods are forced upwardly, the power fluid in the units above the pistons around the piston rods is displaced into the line 221 through which the fluid flows to the valve 211, through the valve 211 and out into the port T of the valve into the line 220 where the displaced fluid joins the power fluid in the line 163 through which the combined displaced fluid and the power fluid in the line from the valve 210 are forced into the cylinder assemblies 42 below the pistons. Thus, no fluid is returend from the units 42 as the only fluid displaced from the cylinders is the lesser volume above the pistons which is directed back into the cylinders below the pistons which requires more volume than the displaced fluid. It is necessary to add fluid to the units in an amount equal to the volume of the piston rods which is a measure of the differences in the volumes above and below the pistons. It will be obvious, therefore, that, since it is necessary to add power fluid to the cylinder assemblies 42, that such fluid also must be admitted to the intake port 222 of the pump 200. This make-up fluid also is taken from the accumulator 253 through the lines 252 and 262 through the check valve 270 into the intake port 222** of the pump.

The actual rate of ascent of the plate 40 as the plate is lifted by the piston rods of the assemblies 41 and 42 is a function of the constant discharge rate of the pump 200 and the volumes of the spaces in the assemblies 41 and 42 into which the power fluid is being pumped. In the assemblies 41, the power fluid is being supplied into the cylinders only below the pistons; and, thus, the volume is determined by the volume of the cylinders below the pistons. In the assemblies 42, however, since the regenerative mode is employed, the volume into which the power fluid is pumped is the difference between the annular space above the pistons around the rods and the space in the cylinders below the pistons. The total combined volume into which the power fluid must be pumped in the cylinder assemblies 41 and 42 is the maximum for the several lift speeds available in the embodiment of the system illustrated in FIG. 14; and, thus, the lift speed number 1 is the lowest speed of lift for this particular form of the system.

To obtain the second lift speed of the system of FIG. 14, the handle of the control valve 290 is depressed applying a pilot pressure in the line 301 to the shuttle valve 302 which shifts to the opposite end position from that shown in FIG. 14 to then apply the pilot pressure to the line 304 actuating the valve 210 communicating the valve with the port T which is connected with the line 261 leading to the return port 222 of the pump 200. The valves 204, 205, and 211 remain at normal unactuated positions so that power fluid is supplied into the cylinder assemblies 41 below the pistons 41*c;* the fluid in the assemblies 41 above the pistons 41*c* is returned; and all of the fluid in the cylinder assemblies 42 both above and below the pistons communicates with the return side of the pump so that the cylinder assemblies 42 are not powered but rather are "floating". This floating condition is brought about by the fact that in the unactuated condition of the valve 211 the cylinders of the assemblies 42 above the pistons communicate through the valve 211 to the port T into the line 220 which connects into the line 163 leading to the cylinders above the pistons. The lines 163 upon actuation of the valve 210 is connected with the port T which communicates with the line 261 and through such line to the intake port 222 of the pump 200 thus placing both the piston and the piston rod ends of the assemblies 42 in communication with the return side of the pump 200 whereby the cylinder assemblies simply float with no power fluid pressure being applied into the units. Thus, the only space into which power fluid is being pumped in lift speed 2 is into the cylinders of the assemblies 41 below the pistons which is less space than the space into which power fluid was pumped in the lift speed 1, so that with the pump still operating at the standard, constant rate, the piston rods 41*b* of the assemblies 41 are forced upwardly at an increased rate of speed compared to the lift speed 1.

With respect to the power fluids balance in the power system in lift speed 2, the fluid in the assemblies 41 above the pistons is returned through the lines 216 and the valve 205 to the line 223. The return fluids flow from the line 223 through the counter-balance valve 232 into the line 261. The counter-balance valve is held open by the high pressure in the pilot line 233 since power fluid is being delivered through the line 213 to the assemblies 41 below the pistons. In the floating condition of the assemblies 42 with the valve 210 actuated, the lines 163 communicate through the valve 210 to the port T. As the piston rods of the assemblies 42 move upwardly, even though the units are in a floating condition, there is fluids transfer occurring as the fluids above the pistons are displaced into the lines 221 flowing through the valve 211 into the line 220 and back into the assemblies 42 below the pistons through the lines 163. Since there is more space below the pistons than above the pistons, in order to maintain the cylinders of the assemblies 42 full as they move upwardly, some make-up fluid is necessary and, thus, flow occurs from the lines 261 through the valve 210 into the lines 163 in a volume equal to the difference in the total volume of the cylinders below the pistons and the returns from above the pistons. Thus, a portion of the fluids being returned from above the pistons in the assemblies 41 will flow upwardly in the lines 261 to the assemblies 42 from the point where the line 261 intersects the line 225 between the counter-balance valves 230 and 232. In the assemblies 41, make-up fluid is required as the power fluid entering the cylinders below the pistons exceeds the returns from above the pistons; and, in the assemblies 42, make-up fluids are required to maintain the cylinders liquid full even in the floating condition. Thus, the made up requirements of both sets of the cylinder assemblies is taken from the accumulator 253 through the line 252 as previously described. The make-up fluid required for the piston ends of the assemblies 41, of course, flows to the intake port 222 of the pump 200, while the make-up fluid required by the floating assemblies 42 moves directly in the lines 261 on the return side of the system without passing through the pump 200. It will be recalled that the returns side of the system is maintained at a pressure of approximately 100 psi by the pump 201 which keeps the accumulator full and supplies additional make-up fluids as required.

To shift the system of FIG. 14 from lift speed 2 to the next higher lift speed 3, the lever of the control valve 290 is released allowing the valve to return to a normal position which opens the pilot line 301 so that the pressure in the line bleeds down through the drain line 300 to the reservoir 343 thereby relieving the pilot pressure on the valve 210 so that the valve 210 returns to the normal, unactuated position at which the valve communicates with the port P. The operating lever of the control valve 291 is then depressed applying a pilot pressure in the line 305 which positions the shuttle valve 310 as shown in FIG. 14 applying a pilot pressure in the line 313 into the shuttle valve 314 which is shifted to the upper end position to apply the pilot pressure into the line 320 actuating the valve 205 communicating the valve 205 with the port T. The other valves 204, 210, and 211 remain at normal, unactuated positions so that the cylinders of the assemblies 42 above and below the pistons communicate with the lines 163 and through the valve 210 and the port P to the power fluid pressure line 213. The pump 200 continues discharge through the port 212 and intakes through the port 222. The actuating of the valve 205 communicates the cylinders of the assemblies 41 above the pistons with the line 215 leading into the lines 162 so that the power fluid is supplied to the assemblies 41 below and above the pistons 41*c*. Thus, both the assemblies 41 and the assemblies 42 are operating in a regenerative mode with fluid above the pistons in the assemblies 41 being displaced through the valve 205 and back through the lines 215 and 162 into the cylinders below the pistons. Similarly, in the assemblies 42, the fluid in the cylinders above the pistons is displacd through the lines 211, the valve 211, and the line 220 into the lines 163 back into the cylinders below the pistons. As both sets of assemblies 41 and 42 are lifting in the regenerative mode, there is no return fluid from either set of cylinder assemblies, and additional power fluid is required in both sets in amounts equal to the differences in the volumes of the cylinders above and below the pistons. On the return side of the pump 200 leading to the port 222, those lines connecting into the valves 204, 205, 210 and 211 are effectively closed off at such valves, namely, the lines 261 and 223 so that in order for return fluid to be supplied to the intake port 222 of the pump 200, which is additional fluid necessary to add into the assemblies 41 and 42, the fluid must flow from the accumulator 253 through the line 252, the line 262, and the filter 263, across through the line 264 and the check valve 270 into the intake port 222. While the counter-balance valve 232 remains open, no effective flow occurs through the valve due to the absence of returns from both of the assemblies 41 and 42. While both sets of the assemblies 41 and 42 are operative in the regenerative mode, the total volume available for effecting lift is less than the volume available in lift speed 2; and, with the constant displacement pump, the rate of ascent of the plate 40 is greater than that of lift speed 2.

To shift from lift speed 3 to lift speed 4, the operating lever of the control valve 291 is released allowing the valve 291 to return to a normal, unactuated position bleeding down the control pressure in the pilot lines 305, 313, and 320. The pressure bleeds down through the drain line 300 to the reservoir. The lever on the control valve 292 is then depressed applying pilot pressure into the shuttle valves 302 and 322 through the line 303. The shuttle valve 302 is positioned as shown in FIG. 14 applying the pilot pressure into the line 304 to actuate the power fluid valve 210. The pilot pressure communicated to the shuttle valve 322 shifts the valve from the position shown in FIG. 14 to an opposite end position applying the pilot pressure through the line 321 to the shuttle valve 314 which is positioned as shown in FIG. 14. The pilot pressure is applied from the shuttle valve 314 through the line 320 to acutate the power fluid valve 205. The power fluid valve 205 is shifted to communicate with the port T so that power fluid is now pumped through the unactuted power fluid valve 204 and through the line 215 and the valve 205 to the cylinder assemblies 41 above and below the pistons 41*c* so that the assemblies are in the regenerative lift mode. The operation of the power fluid valve 210 communicates the valve with the port T which is connected with the return side of the pump 200 through the lines 261. The valve 211 remains unactuated in communication with the port T so that the lines 221 communicate through the valve 211 with the line 220 whereby the small cylinder assemblies 42 both above and below the pistons 42*c* communicate with the return side of the pump 200 whereby the assemblies 42 are fully floating. In the regenerative lift mode of the large cylinder assemblies 41, make-up power fluid is required in the lower ends of the cylinders. Similarly, in the floating condition of the small cylinder assemblies 42, as the pistons move upwardly, make-up fluid is required. Make-up fluid for both sets of cylinder assemblies 41 and 42 comes from the accumulator 253. Since there are no returns from the large cylinder assemblies 41, the make-up power fluid directed to the cylinder assemblies 41 is taken by the pump 200 through the intake port 222 along the line 262 through the filter 263, the line 264, and through the check valve 270 into the line 223 leading to the intake port 222. Make-up fluid required in the floating cylinder assemblies 42 passes from the accumulator 253 through the lines 252 and 261 to the power fluid valve 210. The make-up fluid flows through the power fluid valve 210 into the lines 163 leading to the piston ends of the cylinder assemblies 42. Since the power fluid directed into the system goes only to the cylinder assemblies 41 which are operating in the regenerative mode, the volume into which the power fluid flows at lift speed 4 is less than the volume into which the power fluid flows at lift speed 3, at which both sets of cylinder assemblies are operating in the regenerative mode; and, thus, speed 4 with the pump 200 operating at a constant discharge rate is greater than lift speed 3. It will be recognized that as the constant pressure discharge of the pump 200 is operating against less effective area, the upward force applied is less for speed 4 than speed 3 and, therefore, less weight can be lifted.

The system shown in FIG. 14 is shifted from lift speed 4 to lift speed 5 by releasing the control valve 292 to return to a normal position and moving the operating level of control valve 293 to a position to apply a pilot pressure to the line 323. When the valve 292 returns to a normal, unactuated position, the pilot pressure in the lines 303, 321, 304, and 320 bleed down to the reservoir 243 through the line 300. The pilot pressure in the line 232 from the valve 293 is applied into the shuttle valves 312 and 322 which are both positioned as illustrated in FIG. 14. The pilot pressure is applied from the shuttle valve 322 through the line 321 into the shuttle valve 314 which is positioned as shown in FIG. 14. The pilot pressure is applied from the shuttle valve 312 and also the shuttle valve 314 into the lines 315 and 320, respectively, applying the pilot pressure to actuate both the power fluid valves 204 and 205. Both the valves 204 and 205 are each shifted to communicate with the valve port T. Shifting the valve 204 to the port T connects the lines 162 leading to the piston ends of the cylinder assemblies 41 with the return lines 261 which communicate through the lines 262 and 264 into the intake port 222 of the pump 200. The actuation of the valve 205 communicates the rod ends of the cylinder assemblies 41 through the valve 205 with the line 215 leading to the lines 162 so that the rod ends of the assemblies 41 communicate with the piston ends of the assemblies which are now connected with the intake side of the pump 200 so that the large cylinder assemblies 41 are floating on the return side of the pump. The power fluid valves 210 and 211 remain unactuated so that the valve 210 communicates with the port P which is connected with the power fluid supply line 213 leading to the discharge port 212 of the pump 200. The unactuated power fluid valve 211 communicates with the port T which is connected with the line 220 leading to the power fluid supply lines 163 from the valve 210 so that power fluid is supplied from the lines 163 through the line 220 and the valve 211 to the rod ends of the small cylinder assemblies 42 as well as the piston ends of such power assemblies. Thus, the small cylinder assemblies 42 are operating in the regenerative lifting mode while the large cylinder assemblies 41 are floating. Thus, the highest speed 5 is obtained inasmuch as the volume of the space into which the power fluid is directed in only the set of small cylinder assemblies 42 is less than that volume of the large cylinder assemblies 41 employed in lift speed 4 so that the lift speed 5 is an increment increase in speed over that of lift speed 4. The floating large cylinder assemblies 41 require make-up fluid inasmuch as the displaced fluid above the pistons 41*c* is less than the fluid required to fill the cylinders below the pistons as the pistons move upwardly. The make-up fluid is drawn into the large cylinder assemblies through the lines 261 which lead directly to the line 252 connecting with the accumulator 253. Make-up fluid also is required in the regenerative mode of operation of the small cylinder assemblies 42. The make-up fluid for the small cylinder assemblies taken from the accumulator through the lines 252, 262, and 264 through the check valve 270 into the intake port 222. The counter-balance valve 232 remains open due to the high power fluid pressure in the pilot line 233 though no flow occurs through the counter-balance valve since the power fluid valves 205 and 211 both communicate with the ports T of the valves; and, thus, the lines 223 which lead to the counter-balance valve from the power fluid valves are closed off with no flow occurring. The counter-balance vlave 230 remains closed due to the lower pressure in the pilot line 231 leading to the line 223 connected to the intake port 222 of the pump 200.

When using the system of FIG. 14 for lifting a well tubing string from a well which is under pressure, the lift speeds 1 and 2 are preferably used because of the inherent capability of the system at speeds 1 and 2 to supply a back-pressure for opposing the upward movement of the tubing string in the event that operating conditions shift when coming out of the hole such that the upward force from the well pressure exceeds the weight of the tubing string. At both lift speeds 1 and 2, power fluid is directed to the large cylinder assemblies 41 only below the pistons with the fluid returning from above the pistons passing through the counter-balance and holding valve 232. When a change occurs in the forces on the tubing while lifting the tubing string, as when the lifting force from well pressure exceeds the weight of the tubing string, the resulting decrease in the power fluid pressure below the pistons is reflected in the pilot line 233 which regulates the counter-balance valve 232 closing the valve down to hold a back-pressure in the returning fluids above the pistons in the cylinders 41*a* so that the upward force of the well pressure is opposed by the regulating action of the counter-balance valve 232. This particular manner of controlling back-pressure applies equally to lift speed 1 and to lift speed 2. Lift speeds 3, 4, and 5 should not be used with a well under pressure since the system in these modes of operation is incapable of regulating the back-pressure to oppose a lifting force of well pressure.

It will be understood that in operating this system suitable weight indicating apparatus, not shown, is normally employed to provide the operator with an indication of the actual net weight forces being applied to the system as a result of the weight of the tubing string and any well pressure encountered during operations. This is a safety feature which is highly desirable to enable an operator to monitor operating conditions and anticipate such changes. For example, if an operator is pulling a string of tubing and an unexpected pressure condition develops which tends to lift the tubing, it will be immediately evident at the weight indicating apparatus; and, if the indicated change is such as to present an emergency, the operator can immediately change the mode of operation of the system. At the normal, unactuated position of each of the valves 290 – 293, inclusive, the system is in lift speed 1. Since the control valves return to normal, unactuated positions when the control levers are not held depressed, the operator has simply to remove his hands from the control levers at any time an emergency condition appears to be developing, and the valves will return to the unactuated positions, and the system will immediately revert to lift speed 1 which, as stated, provides the capability of supplying a back-pressure which will oppose a lifting force caused by unexpected well pressure.

The system of FIG. 14 is normally operated at one of two snubbing speeds for running well tubing into a well bore against well pressure. The first of the snubbing speeds is essentially the reverse of lift speed 1 in the sense that all of the control valves 290 – 293, inclusive, remain at unactuated positions; and, thus, the power fluid valves 204, 205, 210, and 211 remain at normal, unactuated positions; and reverse fluid flow for providing downward force is supplied by reversing the pump 200. At such normal positions of the power fluid valves, the valve 204 communicates with the port P so that return fluid within the cylinders 41*a* below the pistons flows through the lines 162 and through the valve 204 into the line 213. At the normal position of the power fluid valve 205, the valve communicates with the port P leading to the lines 223 so that power fluid supplied through the line 223 passes through the valve 205 and the lines 216 into the cylinders 41*a* at the rod ends above the pistons for forcing the pistons downwardly. At the normal, unactuated positions of the power fluid valves 210 and 211, the valve 210 communicates through the port P with the line 213 which, with the reverse operation of the pump 200, is a return line while the valve 211 communicates with the port T connecting the rod ends of the small cylinder assemblies 42 with the piston ends of the cylinder assemblies through the lines 163 so that the small piston assemblies are free floating on the return side of the pump. With the reverse operation of the pump 200, power fluid is discharged from the pump through the port 222 into the line 223. The power fluid flows through the check valve 224 to the branches of the line 223 leading to the valve 211 and to the valve 205. Since the valve 211 is in communication with the port T, the line 223 leading to the valve 211 is closed off. The valve 205, however, is positioned to communicate with the port P so that the power fluid flows through the valve 205 and the lines 216 into the large cylinder assemblies 41 above the pistons at the rod ends of the assemblies to force the pistons and rods downwardly in the assemblies 41. The counter-balance valve 232 is sensing a low pressure through the pilot line 233 which leads to the return line 213 so that the power fluid in the line 223 cannot flow through the counter-balance valve 232. As the pistons 41*c* move downwardly, the fluid in the cylinder assemblies 41 below the pistons is displaced into the lines 162 and through the valve 204 into the line 213. Simultaneously, the pistons and rods in the small, free-floating cylinder assemblies 42 are moving downwardly displacing fluid from the cylinders 42*a* below the pistons 42*c* and requiring replacement fluid in the cylinders above the pistons. The fluid being displaced below the pistons in the assemblies 42 flows into the lines 163, and a portion of the fluid flows through the line 220 and the valve 211 into the lines 221 back into the cylinder assemblies above the pistons 42*c*. The balance of the returning fluid flows through the valve 210 into the line 213 joining the fluid returns from the piston ends of the assemblies 41. The return fluid in the line 213 cannot pass through the check valve 214 and is, thus, diverted into the line 225 passing through the counter-balance valve 230 which is held open by the pilot pressure in the line 231 sensing the higher power fluid discharge pressure in the line 223 from the pump 200. The return fluid flows through the valve 230 in the line 225 to the intersection of the line 225 and the line 261. The connections of the lines 261 into the valves 204 and 210 are closed off since both such valves are in communication with the ports P of the valves; and, therefore, the return fluid must flow through the line 261 to the line 252. A portion of the returning fluid flows in the line 252 to the line 262, through the filter 263 into the line 264, and through the check valve 265 into the line 213 between the check valve 214 and the pump 200, and then through the line 213 to the intake port 212 of the pump 200. With the pistons and rods of the cylinder assemblies 41 and 42 moving downwardly, the fluid flowing into the rod ends of the assemblies is less than the fluids displaced from the piston ends of the assemblies with the difference flowing in the return line 261 passing through the line 252 to the accumulator 253. The accumulator stores the excess return fluid until such time as more fluid is required to be pumped to the assemblies 41 and 42 than is returned from the assemblies during other modes of operation of the system.

Snub speed 2 of the system of FIG. 14 is obtained by placing the large cylinder assemblies 41 on the return side of the pump 200 in a free-floating condition and pumping power fluid to the rod ends of the small cylinder assemblies 42 which has a smaller volume than the rod ends of the large assemblies 41 thereby driving the piston rods **42*b* and the plate 40 downwardly at a more rapid speed than obtained at snub speed 1. Snub speed 2 is achieved by depressing the operating lever of the control valve 293 applying a pilot pressure to the lines 311 shifting the shuttle valve 312 to the upper end position to apply the pilot pressure in the lines 315 to actuate the power fluid valve 204. The pilot pressure in the line 311 also shifts the shuttle valve 310 to the opposite end position from that shown in FIG. 14 applying the pilot pressure to the line 313 which shifts the shuttle valve 314 to the opposite end position applying the pilot pressure to the line 320 which actuates the power fluid valve 205. The actuated valves 204 and 205 communicate with the ports T which connects the piston ends of the cylinder assemblies 41 through the lines 162 and the valve 204 to the return lines 261 and communicates the rod ends of the assemblies 41 through the lines 216, the valve 205, and the line 215 with the head ends of the assemblies so that both rod and piston ends of the assemblies 41 are placed on the return side of the pump 200 by way of the return lines 261; and the assemblies 41** are in a free-floating condition.

At snub speed 2, the valve 210 remains unactuated and, thus, communicates with the port P so that the lines 163 from the piston ends of the small cylinder assemblies 42 communicate through the valve 210 to the line 213 on the return side of the pump 200. The return fluids in the line 213 are diverted from the line 213 into the line 225 because of the check valve 214. The fluids flow in the line 225 through the counter-balance valve 230 which is held open by the high pilot pressure in the line 231 sensing the high pump discharge pressure in the line 223. The return fluid from the piston ends of the small assemblies, join the return fluid from the large assemblies 41 in the line 261. The return fluid exceeds in volume the fluid being pumped to the cylinder assemblies; and, thus, one portion of the return fluid flows to the accumulator 253 while another portion flows through the line 262, the line 264, the check valve 265, and the line 213 to the intake port 212 of the pump 200. The actuated valve 211 communicates the valve 211 with the port P so that power fluid discharged from the pump 200 through the port 222 flows through the check valve 224, the line 223 to the valve 211, and through the valve 211 to the lines 221 through which the power fluid flows to the rod ends of the small cylinder assemblies 42 providing the power fluid above the pistons **42*c* for forcing the small cylinder assemblies downwardly at snub speed 2**.

At both snub speed 1 and snub speed 2, the system has the capability of producing a back-pressure to resist the lowering of a tubing string when the weight of the tubing string overcomes the well pressure so that the net effective force on the tubing string is downwardly. For example, at snub speed 1, when such a condition develops, the pressure above the pistons in the cylinder assemblies 41 is reduced; and, thus, the pressure of the power fluid delivered from the pump port 222 is reduced so that the pilot line 231 senses a reduced pressure throttling down the counter-balance valve 230 through which the return fluid flows from both the large and small cylinder assemblies. The throttled-down returns, therefore, provide a back-pressure below the pistons in the cylinder assemblies to support the lowering of the tubing string. Inasmuch as the pump 240 maintains approximately 100 psi in the return side of the system, absent the additional pressure imposed due to the weight of the tubing string on the cylinder assemblies, it will always require some power fluid pressure above the pistons in at least one set of the cylinder assemblies when lowering a tubing string. At snub speed 2, the portion of the return fluid from the large piston assemblies 41 flows directly to the return lines 261 not passing through the counter-balance valve 230; however, the returns from the small cylinder assemblies 42 do flow through the line 213 and the counter-balance valve 230 so that a back-pressure is available at snub speed 2 in the small cylinder assemblies for supporting a tubing string when the weight of the string overcomes the well pressure.

It will be recognized that, when operating the system of FIG. 14, both during the lift speeds and during the snub speeds, at the end of each stroke of the traveling slips 33, it is necessary to return the traveling slips to the opposite end position for operating the slips through another stroke. For example, during the various lift speeds the system is being used to raise a tubing string from a well bore. Each time that the traveling slips complete an upward stroke, it is necessary to return the slips downwardly to again grip the tubing string for the succeeding stroke. Therefore, during each of the lift speeds, the traveling slips 33 are engaged with the tubing string at the lower end position of each stroke. While securing the traveling slips with the tubing string, the appropriate one of the lower fixed slips 52 or 53 is clamped to the tubing string to hold the tubing string. If the weight of the tubing exceeds the force of well pressure, the slip set adapted to hold against downward force is used. Alternatively, if the well pressure exceeds the weight of the tubing string, the other set of fixed slips is employed. Similarly, the direction or position of orientation of the upper traveling slips is dependent upon whether the force of the tubing string on the slips is upwardly or downwardly. During lifting, after the traveling slips are raised to the upper end position, the appropriate lower slips are engaged with the tubing string while the traveling slips are disengaged. The system is then operated at a snub speed, which preferably would be snub speed 2, for rapid return of the traveling slips downwardly to reengage the tubing string to perform another upward lifting stroke. Similarly, when snubbing or forcing the tubing string downwardly into a well bore, the tubing string is gripped by the traveling slips 33 at an upper end of a stroke while the appropriate fixed lower slips are used to hold the tubing string. The tubing string is then forced downwardly at the desired snubbing speed until the traveling slips are at a lower end position. At the lower end position, the appropriate set of fixed lower slips are secured to the tubing string, the traveling slips are disengaged from the tubing string, and the slips are raised back upwardly at a lift speed which may be as high as lift speed 5 to increase the speed of operation. Of course, while the slips are being returned to the upper end position, the tubing string is held by the appropriate set of fixed lower slips. In cycling the traveling slips back to the starting position whether snubbing or lifting is being performed, the desired return speed is obtained by operating a selected one of the control levers 290 - 293, in accordance with the previous detailed description of the various available lift and snub speeds.

It will also be recognized that it is necessary to reverse the direction of operation of the pump 200 when cycling between end positions. For example, when lifting, the pump discharges through the port 212 and when snubbing the pump discharges through the port 222. Thus, when lifting, in order to return the traveling slips downwardly for the next stroke, the pump discharge direction is reversed to force the slips downwardly. Similarly, when snubbing, to return the slips back upwardly, it is necessary to shift the pump discharge direction to a lift mode to raise the slips. The entire operation is conveniently and simply controlled by manipulation of the control lever for the pump 200 and one of the control levers of the control valves 290 - 293, inclusive.

Figure 15:
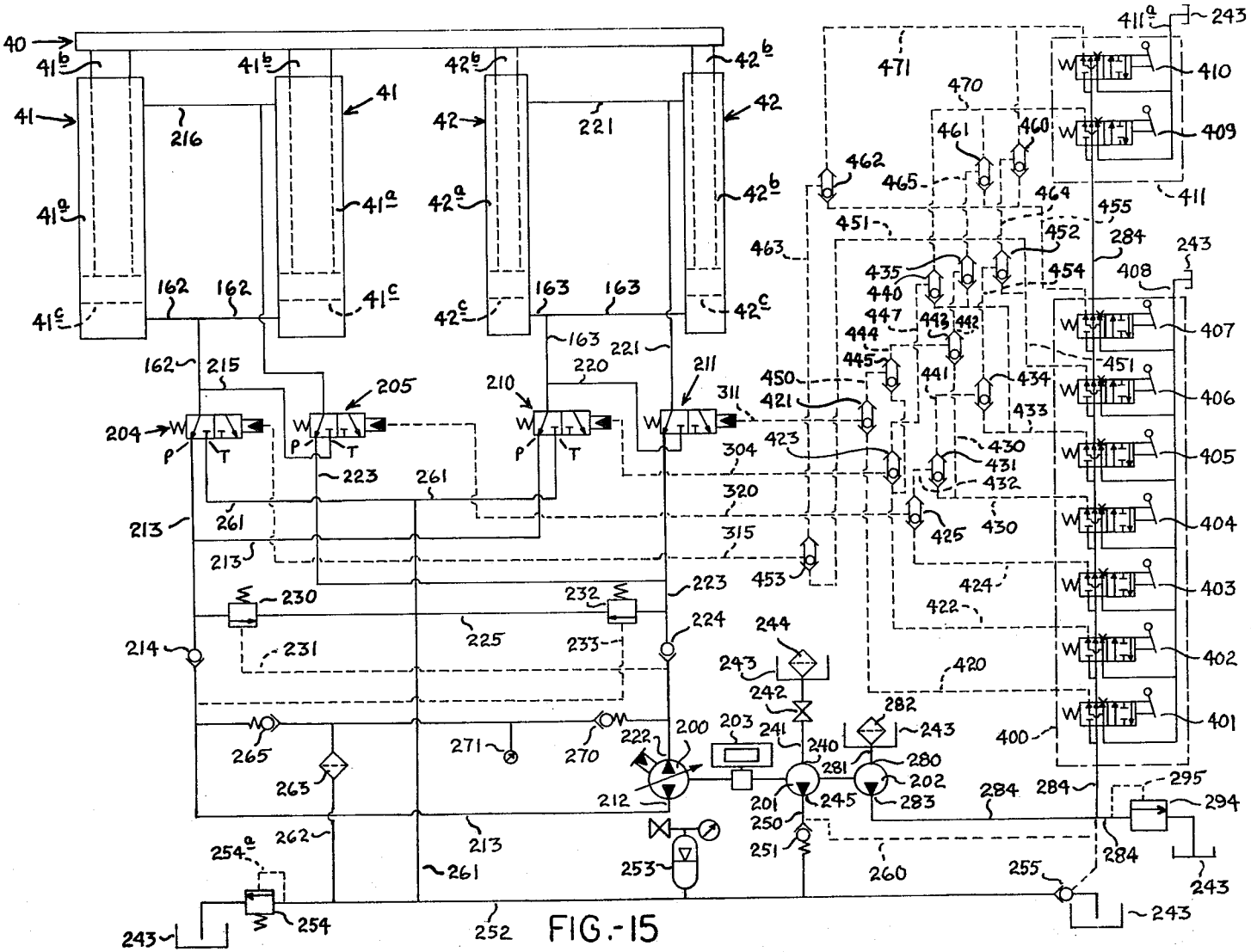
FIG. 15 is a schematic view of a modified form of hydraulic control system for operating the snubbing unit over a range of eight lift speeds and three snubbing speeds.

FIG. 15 schematically illustrates another arrangement of a hydraulic power fluid supply and control system for a tube handling device embodying the features of the invention wherein eight lift speeds and three snubbing speeds are obtainable. This particular arrangement of the power and control system is preferably used for shorter stroke cylinder assemblies due to the fact that certain of the available speeds in this particular form of the system may present column failure problems, particularly with the small set of cylinder assembies, especially with strokes as long as 12 feet. The system of FIG. 15 differs from that of FIG. 14 only in the combination of shuttle valves and control valves used. The remainder of the system is identical to that of FIG. 14; and, thus, the various components of the hydraulic power or working fluid portions of the system, the control fluid sypply, and the accumulator portions of the system are identified by the same reference numerals used in the description of the form of the system of FIG. 14. The system of FIG. 15 includes a control panel 400 on which are mounted a series of lift speed selector control valves 401 - 407, inclusive. The valves are supplied with high-pressure control fluid through the line 284. The control valves 401 - 407 drain to the reservoir 243 through a drain line 408 connected into all of the valves. Another set of snub speed selector control valves 409 and 410 are mounted on a panel 411. The control valves 409 and 410 are also supplied with high-pressure control fluid through the line 284 and drain to the reservoir 243 through a line 411*a*. The control valves 401 - 407, 409, and 410 are all connected through a series of shuttle valves to the power fluid valves 204, 205, 210, and 211. The control valves each include an operating lever biased to a normal position to which the valves return except when manually depressed. Each of the control valves is normally unactuated and, thus, does not conduct pilot fluid pressure except when actuated by the valve control lever. The power fluid valves 204, 205, 210, and 211 each communicate with the valve port P at the normal, unactuated position of the valves. When actuated, each of the power fluid valves shift to communicate with the valve port T. All of the lift speed and snub speed selector valves are two-position, manual, directional control valves.

Referring to FIG. 15, the control valve 401 is connected by a pilot line 420 to a shuttle valve 421 which is connected by pilot line 311 to the power fluid valve 211. The control valve 402 is connected by a pilot line 422 to a shuttle valve 423 which is connected by the pilot line 304 to the power fluid valve 210. The control valve 403 is connected by a pilot line 424 to a shuttle valve 425 which is connected with the pilot line 320 leading to the power fluid valve 205. The control valve 404 is connected by a pilot line 430 to a shuttle valve 431 which is connected by a pilot line 432 to the shuttle valve 425. The control valve 405 is connected with a pilot line 433 which includes three branches leading to shuttle valves 434, 435, and 440. The shuttle valve 434 connects with the shuttle valve 431 by a pilot line 441. The shuttle valve 435 connects through a pilot line 442 with a shuttle valve 443 which connects with a pilot line 444 leading to a shuttle valve 445. The shuttle valve 445 connects by a pilot line 450 to the shuttle valve 421. The shuttle valve 443 is also connected with a branch of the pilot line 430. The control valve 406 is connected with a pilot line 451 which leads to a shuttle valve 452 and a shuttle valve 453. The shuttle valve 452 is connected by pilot line 454 with the shuttle valve 434. The shuttle valve 453 is connected with the pilot line 315 leading to the power fluid valve 204. The control valve 407 is connected with a pilot line 455 which leads to shuttle valves 460, 461, and 462. The shuttle valve 462 is connected by a pilot line 463 with the shuttle valve 453. The shuttle valve 460 connects by pilot line 464 with the shuttle valve 452. The shuttle valve 461 is connected by a pilot line 465 with the shuttle valve 435. The control valve 409 is connected by a pilot line 470 with the shuttle valves 461 and 440. The control valve 410 is connected by a pilot line 471 with the shuttle valves 460 and 462. The control valves 401 - 407 control the flow of pilot pressure fluid to the shuttle valves which control the application of the pressure fluid to the power fluid valves 204, 205, 210, and 211 for operating the system through the eight lift speeds. At the normal, unactuated positions of the valves 401 - 407, the system is in lift speed 1. The other seven lift speeds are each obtainable by operation of a single selected one of the control valves. Similarly, the control valves 409 and 410 are normally at unactuated positions at which the system is in snub speed 1. The other two snub speeds are each obtained by actuating a selected one of the control valves 409 and 410.

As indicated above, at all of the normal settings of the control valves of the system of FIG. 15, the system is at lift speed 1 when the pump 200 is operated to discharge through the port 212 and intake through the port 222; and, the system is at snub speed 1 when the pump 200 is reversed to discharge through the port 222 and intake through the port 212. Thus, in order to operate the system at lift speed 1 after all portions of the system are liquid full, the control lever of the pump 200 is positioned to discharge the pump through the port 212 into the lines 213. The power fluid in the lines 213 flows through the valves 204 and 210, both of which at normal, unactuated positions communicate with the ports P. The power fluid flowing through the valve 204 is delivered to the piston ends of the large cylinder assemblies 41. Similarly, the power fluid delivered to the valve 210 flows from the valve 210 in the line 163 to the piston ends of the small cylinder assemblies 42. With power fluid pumped into the piston ends of both of the sets of cylinder assemblies, the pistons and rods of both sets of assemblies are forced upwardly. At the normal settings of the power fluid valves 205 and 211, the rod ends of both sets of cylinder assemblies 41 and 42 are communicated with the return lines 223. The rod ends of the cylinder assemblies 41 connect through the lines 216 to the valve 205 which connects at its normal setting with one branch of the return line 223. Similarly, the rod ends of the cylinder assemblies 42 connect through the lines 221 with the valve 211 which communicates with another branch of the return line 223. The power fluid pressure in the line 213 is sensed through the pilot line 233 holding the counter-balance valve 232 open so that fluid returns in the line 223 from the rod ends of both of the cylinder assemblies flows through the line 225 to the line 261, through the line 252 to the line 262, through the filter 263 into the line 264, and through the check valve 270 into the line 223 on the pump side of the check valve 224 and thence into the pump intake port 222. Since the cylinder assembly pistons and rods are moving upwardly with power fluid delivered into the piston ends of both sets, the return fluid being displaced from the rod ends of the assemblies is less in volume than the volume of power fluid pumped into the piston ends of the assemblies; and, therefore, make-up fluid is required as the cylinder assemblies are pumped upwardly. The make-up fluid is drawn from the accumulator 253 through the line 252 joining the return fluid from the cylinder assemblies and flowing along the previously described path through the filter 263 and the check valve 270 to the pump intake port 222.

The system is operated at lift speed 1 through a complete upward stroke raising the plate 40 and the upper traveling slips 33 to lift a tubing string. At the upper end of the stroke, the pump 200 is stopped, one set of the lower fixed slips 52 or 53, depending upon the direction of the static force on the tubing string as affected by the tubing string weight and well pressure, is clamped with the tubing string while the upper traveling slips are released from the tubing string. The pump 200 is then reversed to discharge through the port 222 and intake through the port 212 for returning the traveling slips downwardly to the lower end of the stroke at a selected one of the snub speeds which will be described hereinafter. At the lower end of the stroke, the traveling slips are reengaged with the tubing string while the fixed lower slips are disengaged and the system is operated through another upward stroke. This sequence of operation is repeated until the tubing string is either raised to the desired level or removed from the well bore. If, in raising the tubing string at lift speed 1, the well pressure force on the tubing string should exceed the tubing string weight applying a net upward force on the tubing string, a back-pressure is held on the sets of cylinder assemblies 41 and 42 above the pistons responsive to the reduction of pressure in the power fluid line 213 as reflected through the pilot line 233 closing down the counter-balance valve 232 proportional to the reduction in the power fluid pressure. Since all of the fluid returns from both of the cylinder assemblies flow through the counter-balance valve 232, the desired back-pressure is held on the cylinder assemblies above the pistons to resist the upward force of well pressure on the tubing string. The back-pressure, of course, is self-regulating through the valve 232 because of the pilot line 233 connection with the power fluid supply line 213. Lift speed 1 is the lowest speed at which the system is operable because of the fact that the power fluid is delivered into the largest available volume of the two sets of cylinder assemblies, which is that portion of the cylinders of the assemblies below the pistons.

The system of FIG. 15 is shifted into lift speed 2 by depressing the control lever of the control valve 401. A pilot pressure is applied in the line 420 shifting the shuttle valve 421 to an upper end position communicating the pilot pressure through the line 311 to the valve 211. The valve 211 is actuated to communicate the valve with the port T which is connected with the line 220. The valves 204, 205, and 210 remain unactuated. Thus, the valve 204 communicates the power fluid pressure in the line 213 with the large cylinder assemblies 41 below the pistons. The valve 205 remaining unactuated communicates the cylinder assemblies 41 at the rod ends with the return fluid line 223. The valve 210 remains unactuated in communication with the port P connected with the power fluid line 213 to supply power fluid through the lines 163 into the small cylinder assemblies below the pistons. Since the valve 211 is now actuated to communicate the valve with the line 220, power fluid is also supplied through the valve 211 to the rod ends of the small cylinder assemblies 42 so that the small cylinder assemblies are in the regenerative mode of lifting. Thus, at lift speed 2 power fluid is delivered to the large cylinder assemblies 41 into the space only below the pistons while in the small cylinder assemblies power fluid is delivered both above and below the pistons so that there is slightly less power fluid requirement by the small cylinder assemblies with a net total requirement less than that for lift speed 1, so that at a constant pump discharge rate lift speed 2 is greater than lift speed 1. Return fluid from the large cylinder assemblies 41 passes through the previously described path along the line 223 and connected lines to the pump intake port 222. There are no return fluids from the small cylinder assemblies 42 which are operating in the regenerative mode. Make-up fluid is required in both the large and small cylinder assemblies, such make-up fluid being taken from the accumulator 253 along the previously described path to the pump intake port 222 joining the returns from the rod ends of the large cylinder assemblies 41. At the upper end of the stroke, the cylinder assemblies are retracted at whatever snub speed is selected, preferably at the highest snub speed, to return the traveling slips downwardly. The previously discussed engagement and disengagement of the traveling and fixed slips with the tubing string are performed to properly rig the system for the required changes between the upward and downward strokes.

The system of FIG. 15 is shifted to lift speed 3 by depressing the control lever of the control valve 402 to apply a pilot pressure thorugh the line 422 which is communicated along both branches of the pilot lines 422 to the shuttle valves 423 and 445. The pilot pressure in the shuttle valve 423 shifts the valve to an upper end position applying the pilot pressure to the pilot line 304 to actuate the power fluid valve 210. The pilot pressure in the shuttle valve 445 from the line 422 shifts the shuttle valve upwardly applying the pilot pressure through the pilot line 450 to the shuttle valve 421 which remains at the lower end position shown in FIG. 15 applying the pilot pressure to the line 311 to actuate the power fluid valve 211. The power fluid valves 204 and 205 remain unactuated with the large cylinder assemblies 41 communicating with the power fluid below the pistons through the valve 204 and the supply line 213 and with the return fluid line 223 below the piston through the valve 205. With the power fluid valves 210 and 211 both actuated, the valve 210 communicates the small cylinder assemblies below the pistons with the return line 261; and the valve 211 communicates the small cylinder assemblies above the pistons with the return line 223 so that the small cylinder assemblies are floating on the return side of the pump 200. The lines 223 and 261 are placed in communication with each other through the open counter-balance valve 232 which is being held open by the power fluid pressure in the line 213 through the pilot line 233. Thus, fluid is returning from the rod ends of the large piston assemblies 41 and the small piston assemblies 42 are floating so that the only lifting force supplied is due to the power fluid being introduced into the piston ends of the large cylinder assemblies. Both the large and the small cylinder assemblies require make-up fluid which is taken from the accumulator 253. Since the power fluid is directed into only the piston ends of the large cylinder assemblies which is less volume than the cylinder assembly space into which the power fluid is directed in lift speed 2, lift speed 3 is an increment faster than lift speed 2. At the upper end of each stroke, the system is reversed into a selected snub speed and the proper slips are to return the traveling slips to the lower end position for another stroke.

The system of FIG. 15 is operated at lift speed 4 by depressing the control lever of the control valve 403. All of the other control valves remain unactuated. Pilot pressure is applied in the line 424 shifting the shuttle valve 425 to the upper end position applying the pilot pressure to the line 320 to actuate the power fluid valve 205 communicating the valve with the port T. The power fluid valve 204 remains unactuated communicating with the port P. The rod ends of the large cylinder assemblies 41 communicate through the lines 216, the valve 205, and the line 215 with the lines 162 which lead into the piston ends of the large cylinder assemblies. Power fluid is directed from the line 213 through the valve 204 into the lines 162 so that the large cylinder assemblies 41 are in the regenerative lift mode. The power fluid valves 210 and 211 connected with the small cylinder assembles 42 remain unactuated. The power fluid valve 210 communicates with the port P connected with the power fluid line 213 so that power fluid is directed into the piston ends of the small cylinder assemblies. The power fluid valve 211 communicates with the port P which is connected with the return line 223 so that fluid in the small cylinder assemblies above the pistons at the rod ends is returned to the pump 200 through the counter-balance valve 232. The large cylinder assemblies are operating in the regenerative lift mode while the small cylinder assemblies are lifting responsive to power fluid directed into only the piston ends of the assemblies. Make-up fluid is required by both sets of cylinder assemblies taken from the accumulator 253 through the lines 252, 262, and 264 through the check valve 270 into the intake port 222. The volume of the space into which the power fluid is directed in lift speed 4 is less than that of lift speed 3; and, thus, lift speed 4 is an increment faster than lift speed 3. At the upper end of each stroke in lift speed 4, the operating lever on the control valve 403 is released; and the pump 200 is stopped. The necessary slip engagements and disengagements are performed and the pump 200 is reversed lowering the traveling slips at the desired snub speed.

The system of FIG. 15 is operated at lift speed 5 by discharging the pump 200 through the port 212 and depressing the operating lever of the control valve 404. A pilot pressure is applied in the line 430 to the shuttle valves 431 and 443. The shuttle valve 431 shifts to the upper end position applying the pilot pressure to the line 432 into the shuttle valve 425 which remains at a lower end position applying pilot pressure through the line 320 to the power fluid valve 205 actuating the power fluid valve. The actuated power fluid valve 205 communicates the rod ends with the piston ends of the large cylinder assemblies 41 through the valve 205, the line 215, and the lines 162. At the unactuated position of the valve 204, the lines 162 communicate with the power fluid line 213 so that the large cylinder assemblies 41 are in the regenerative lift mode. The pilot pressure in the line 430 to the shuttle valve 443 shifts the shuttle valve to an upper end position applying the pilot pressure through the line 444 into the shuttle valve 445. The pilot pressure applied into the shuttle valve 445 positions the valve at the lower end position applying the pilot pressure through the line 450 to the shuttle valve 421. The shuttle valve 421 is moved to the lower end position applying the pilot pressure through the line 311 to the power fluid valve 211. The valve 211 is actuated communicating the valve with the port T so that the rod and piston ends of the small cylinder assemblies are connected with each other through the line 221, the valve 211, the line 220, and the lines 163. The power fluid valve 210 remains unacutated and, thus, connecting the power fluid line 213 through the valve 210 with the lines 163. The small cylinder assemblies 42 are, therefore, in the regenerative lift mode. With both sets of cylinder assemblies in the regenerative lift mode, power fluid is supplied to both ends of both sets of cylinder assemblies; and, since the assemblies are moving upwardly, make-up power fluid is required since more fluid must be pumped into the piston ends of the assemblies than is returned from the rod ends of the assemblies. While the lines 223 and 261 leading to the pump intake port 222 are effectively closed at the power fluid valves and there is no return fluid to the pump, the pump intakes the necessary make-up fluid through the port 222 along the path including the check valve 270, the line 264, the filter 263, the line 262, and the line 252 leading to the accumulator 253. While the counter-balance valve 232 remains open due to the pilot pressure in the line 233, there is no flow in the lines 223 and 225 since all of the make-up fluid must come to the pump intake port through the previously described path from the accumulator. The effective volume of the space of both sets of cylinder assemblies into which power fluid is pumped when operating in the regenerative lift mode at lift speed 5 is less than the space available at lift speed 4 so that lift speed 5 is an increment increase in rate over the lift speed 4. When the traveling slips 33 reach the upper end of a stroke at lift speed 5, the pump 200 is stopped and the control valve lever 404 is released. The traveling slips are then returned downwardly at a selected snub speed to begin the next stroke.

The system of FIG. 15 is operated at lift speed 6 by discharging the pump 200 through the port 212 and depressing the control lever on the control valve 405. Pilot pressure is applied through the lines 433 to the shuttle valves 434, 435, and 440. The pilot pressure in the shuttle valve 434 shifts the shuttle valve to an upper end position applying the pilot pressure through the line 441 to the shuttle valve 431 which is positioned at a lower end position applying the pilot pressure through the line 432 into the shuttle valve 425. The shuttle valve 425 is moved to a lower end position applying the pilot pressure through the line 320 to the power fluid valve 205 actuating the power fluid valve to communicate the rod and piston ends of the large cylinder assemblies 41 with each other through the lines 216, the valve 205, the line 215, and the lines 162. The power fluid valve 204 remains unactuated in communication with the power fluid supply line 213 so that the large clyinder assemblies 41 are operated in the regenerative lift mode. The pilot pressure applied through the line 433 to the shuttle valve 435 shifts the valve upwardly and is communicated through the line 442 into the shuttle valve 443 which is moved to a lower end position applying the pilot pressure through the line 444 into the shuttle valve 445 which is also shifted to a lower end position. The pilot pressure is applied from the shuttle valve 445 through the line 450 to the shuttle valve 421 which is moved to a lower end position applying the pilot pressure through the line 311 to the power fluid valve 211 actuating the power fluid valve to communicate the valve with the port T. The pilot pressure being applied in the line 433 to the shuttle valve 440 moves the shuttle valve to an upper end position applying the pilot pressure through the line 447 into the shuttle valve 423 which is shifted to a lower end position applying the pilot pressure through the line 304 to the power fluid valve 210 which is actuated to communicate with the valve port T. With both the power fluid valve 210 and 211 actuated, the rod and the piston ends of both of the small cylinder assemblies 42 are communicated with each other and with the return side of the pump 200 through the lines 261 so that the small cylinder assemblies are floating on the return side of the pump while the large cylinder assemblies 41 are operating in a regenerative lift mode. Both sets of cylinder assemblies require make-up fluid which is taken from the accumulator 253. The portion of the make-up fluids required by the floating small cylinder assemblies flows from the accumulator through the lines 261 connected to the power fluid valve 210. The make-up fluid required by the pump to be delivered as power fluid to the large cylinder assemblies flows from the accumulator along the line 262 and 264 through the check valve 270 to the pump intake port 222. When the upper end of the stroke at lift speed 6 is reached, the pump 200 is stopped and the control lever of the valve 405 is released to allow the control valve 405 to return to the normal, unactuated position. The pilot pressure in the lines controlling the power fluid valve 205 bleeds down through the line 408 to the reservoir 243. To return the traveling slips downwardly, the pump 200 is reversed and the system is placed in the desired snub speed for the downward stroke. The necessary connections and disconnections are made between the tubing string and the traveling and fixed slips.

The system of FIG. 15 is operated at lift speed 7 by running the pump 200 to discharge from the port 212 and intake at the port 222 along with depressing the control lever of the control valve 406. Pilot pressure is applied through the line 451 into the shuttle valve 453 which is shifted to an upper end position applying the pilot pressure through the line 315 to the power fluid valve 204 actuating the valve communicating the valve with the port T which connects with the return lines 261. The pilot pressure in the line 451 is also communicated to the shuttle valve 452 which is shifted to an upper end position opening the shuttle valve into the line 454 through which the pilot pressure is applied to the shuttle valve 434 which is moved to a lower end position communicating the pilot pressure through the line 441 into the shuttle valve 431. The shuttle valve 431 is shifted to a lower end position applying the pilot pressure through the line 432 to the shuttle valve 425 which is shifted to a lower end position to communicate the pilot pressure through the line 320 into the power fluid valve 205 which is actuated to communicate the valve with the port T. The rod ends of the large cylinder assemblies 41 are communicated through the valve 205, the line 215, and the lines 162 with the piston ends of the assemblies which, through the line 162 and the power fluid valve 204, communicate with the return lines 261 so that the large cylinder assemblies are free-floating on the return side of the pump 200. The power fluid valve 210 and 211 remain unactuated so that the piston ends of the assemblies 42 communicate with the power fluid line 213 through the valve 210 and the lines 163. The rod ends of the small cylinder assemblies 42 communicate through the lines 221 and the valve 211 with the lines 223 which communicates through the counter-balance valve 232 with the return side of the pump 200. Thus, the large cylinder assemblies 41 are free-floating while the small cylinder assemblies 42 are lifting with power fluid pressure being directed only into the piston ends of the assemblies. The volume of the piston ends of the small assemblies 42 at lift speed 7 is less than the volume into which the power fluid is directed at lift speed 6 so that lift speed 7 is an increment faster than lift speed 6. In the free-floating lift mode of the large cylinder assemblies 41, make-up fluid is required inasmuch as the displaced fluid from the rod ends of the assemblies is less than is required to flow into the piston ends of the assemblies as the pistons move upwardly. Similarly, the displaced fluid from the rod ends of the small cylinder assemblies 42 is less than the power fluid introduced into the piston ends of the small cylinder assemblies so that make-up fluid is also required for the small cylinder assemblies. The make-up fluid supplied to the large cylinder assemblies passes from the accumulator 253 through the lines 252 and 261 to the valve 204 from which the make-up fluid flows into the large cylinder assemblies through the lines 162. The required make-up fluid supplied in the form of power fluid to the small cylinder assemblies is taken into the pump 200 through the intake port 222 and the check valve 270, the lines 264, and 262, and the line 252 from the accumulator 253. Return fluid from the small cylinder assemblies flows through the valve 211, the line 223, the counter-balance valve 232, and into the line 261 at the intersection of the lines 261 and 225. Depending upon the volume requirements of the make-up for the large cylinder assemblies, some or all of the returns from the small cylinder assemblies may flow to the large cylinder assemblies or may flow through the system to the return side of the pump. At lift speed 7, with pressure fluid being directed into only the piston ends of the small set of cylinder assemblies 42, the space into which the power fluid is pumped is less than that of speed 6; and, thus, lift speed 7 is an increment faster than lift speed 6. The traveling slips are raised to the upper end of the stroke at which point the pump 200 is stopped, the control lever of the control valve 406 is released, the lower fixed slips are secured with the tubing string, and the traveling slips are disengaged from the string. The pump 200 is then reversed and the appropriate control lever is depressed to obtain the desired snub speed to return the traveling slips to a lower end position.

The system of FIG. 15 is operated at lift speed 8 by running the pump 200 to discharge through the port 212 and intake through the port 222 while depressing the operating lever of the control valve 407. Operationally, the pressure fluid valves 204, 205, and 211 are actuated to place the large cylinder assemblies 41 free-floating on the return side of the pump and the small cylinder assemblies 42 in a regenerative lift mode. Specifically, the pilot pressure is applied to the line 455 through which the pressure is communicated into the shuttle valves 460, 461, and 462. The shuttle valve 460 shifts to an upper end position applying the pilot pressure in the line 464 to the shuttle valve 452 which is moved to a lower end position applying the pilot pressure to the line 454 connected into the shuttle valve 434. The shuttle valve 434 is moved to a lower end position applying the pilot pressure through the line 441 to the shuttle valve 431 which is moved to a lower end position applying the pilot pressure through the line 432 into the shuttle valve 425 which is shifted downwardly to apply the pilot pressure through the line 320 to the power fluid valve 205 which is actuated to communicate the valve with the port T. The pilot pressure in the line 455 shifts the shuttle valve 461 upwardly applying the pressure into the pilot line 465 connected into the shuttle valve 435 which is moved downwardly to communicate the pilot pressure into the line 442 leading to the shuttle valve 443. The shuttle valve 443 is shifted downwardly to apply the pilot pressure into the line 444 connected into the shuttle valve 445 which is moved to a lower end position. The pilot pressure is applied from the shuttle valve 445 in the line 450 to the shuttle valve 421 which is shifted downwardly to apply the pilot pressure through the line 311 to the pressure fluid valve 211 actuating the valve to communicate the valve with the port T. The pilot pressure applied from the line 455 into the shuttle valve 462 shifts the valve to an upper end position applying the pilot pressure through the line 463 into the shuttle valve 453 which is shifted downwardly to apply the pilot pressure through the line 315 to the pressure fluid valve 204 which is actuated to connect the valve with the port T. With both of the pressure fluid valves 204 and 205 actuated, the valve 205 communicates the rod and piston ends of the large cylinder assemblies 41 with each other through the valve 205, the line 215, and the lines 162. The pressure fluid valve 204 connects the intercommunicating piston and rod ends of the large cylinder assemblies 41 with the return line 261 so that the large cylinder assemblies are connected with the intake port 222 of the pump 200 in a floating condition. The pressure fluid valve 210 remains unactuated and, thus, connected with the pressure fluid line 213 from the discharge side of the pump while the actuated pressure fluid valve 211 interconnects the rod and piston ends of the small cylinder assemblies 42 through the valve 211 and lines 220 and 163 so that pressure fluid from the discharge side of the pump is applied into both ends of the small cylinder assemblies operating the small cylinder assemblies in the regenerative mode. Since operation of the small cylinder assemblies in the regenerative mode provides less pressure fluid volume than supplying the fluid directly into only the piston ends of the small assemblies as in lift speed 7, lift speed 8 is an increment increase in speed over lift speed 7. The floating large cylinder assemblies 41 require make-up fluid as the fluid displaced from the rod ends of the assemblies is not sufficient to fill the piston ends of the assemblies as the piston rods are extended. Thus, make-up fluid to the large cylinder assemblies 41 flows from the accumulator 253 through the lines 252 and 261 and through the valve 204 into the line 162 joining the fluid being recirculated from the rod ends to the piston ends of the assemblies through the line 215. Make-up fluid is supplied to the small piston assemblies 42 by the pump 200 which intakes the fluid through the port 222 along the path including the check valve 270, the line 264, the line 263, and the line 252. At the upper end of each stroke in lift speed 8, power fluid delivery from the pump 200 is stopped and the operating lever for the control valve 407 is released to return to a normal, unactuated position. The traveling slips are returned downwardly by reversing the pump 200 and operating the desired snub speed lever, depending upon the return speed wanted.

In operating the system of FIG. 15 on a well under pressure for lifting a tubing string from the well, only those speeds which should be used of the eight available speeds are the ones which permit holding a back-pressure in at least one of the sets of cylinder assemblies at that stage in the lifting operation when the upward force on the tubing string from the well pressure equals or exceeds the weight of the tubing string. The speeds at which a back-pressure may be held on the system are those in which return fluids must flow through the counter-balance valve 232 which is controlled by the pilot line 233 leading to the power fluid pressure line 213 on the discharge side of the pump 200. When the force conditions change causing a pressure reduction in the power fluid pressure side of the system, the lower pressure in the pilot line 233 causes partial closure of the counter-balance valve 232 to reduce the return fluids flow rate in the line 225 through the valve 232. The lift speeds at which a back-pressure may be held in the return fluids lines of the system are lift speeds 1, 2, 3, 4, and 7. At the other speeds, such fluid returns as occur in the system do not flow through a valve which can meter the returns responsive to the driving fluid pressure.

The system of FIG. 15 is operable at any one of three snubbing speeds for lowering a tubing string into a well bore. Snub speed 1, which is the lowest of the snub speeds, is obtained by operating the pump 200 to discharge through the port 222 and intake through the port 212. Power fluid is pumped only to the rod ends of both cylinder assemblies and returned from the piston ends of both sets of assemblies. The power fluid and return fluid flow directions in the system are obtained with the power fluid valve 204, 205, 210 and 211 unactuated. Since it is not necessary to actuate these power fluid valves, it is not required that either of the control levers of the control valves 409 or 410 be depressed. The pump 200 discharges power fluid from the port 222 into the line 223, through the check valve 224, and through the branches of the line 223 to the power fluid valve 205 associated with the large cylinder assemblies 41 and the power fluid valve 211 associated with the small cylinder assemblies 42. The valve 205 is in communication with the port P connected with the line 223 so that the power fluid flows in the lines 216 to the rod ends of the large cylinder assemblies 41 forcing the pistons **41*c* downwardly. Similarly, the valve 211 is connected with the port P leading to the line 223 so that the power fluid is delivered through the valve 211 and the lines 221 to the rod ends of the small cylinder assemblies 42 for applying a downward pressure to the pistons 42c of the assemblies. Return fluid from both the large and small cylinder assemblies flows through the valves 204 and 210, respectively, into the lines 213 through which the fluids flow to the counterbalance valve 230 which is held open due to the high pilot pressure conducted to the valve 230 through the pilot line 231 leading from the line 223 on the discharge side of the pump 200. The return fluid cannot flow through the check valve 214 in the line 213 and, thus, must flow only along the line 225 through the valve 230. At the intersection of the lines 225 and 261, the return fluid flows into the line 261 to the line 252 and along the line 252 to the line 262. Return fluid flows in the line 262, through the filter 263, and through the check valve 265 back into the line 213 below the check valves 214, and along the line 213 to the intake port 212 of the pump 200. Since the pistons of the cylinder assemblies are moving downwardly discharging the return fluid from the cylinders below the pistons in both the large and small cylinder assemblies, while the power fluid forcing the pistons downwardly flows into the annular space of the cylinder assemblies, the volume of return fluid exceeds the power fluid with the excess returns being displaced into the accumulator 253 along the line 252. When the piston rods of the cylinder assemblies 41 and 42 are fully retracted with the traveling slips 33 at a lower end position, the traveling slips are disengaged from the tubing string, the appropriate set of lower fixed slips is secured with the tubing string, and the traveling slips are returned upwardly by utilizing one of the available lift speeds which may be the fastest lift speed eight to return the slips upwardly as rapidly as possible. As many cycles of operation or strokes are used as necessary to force the tubing string down the desired distance in the well bore. Snub speed 1** is the lowest of the snub speeds as the volume of the combination of both sets of the cylinder assemblies above the pistons is used for displacing the pistons downwardly; and, thus, the rate of downward movement is the lowest available at a constant pump discharge rate.

The system of FIG. 15 is operated at snub speed 2 by discharging the pump 200 through the port 222 and depressing the operating lever of the operator valve 409 which actuates the power fluid valves 210 and 211. The net effect of such valve positioning is to supply power fluid only into the rod ends of the large cylinder assemblies 41 while placing the small cylinder assemblies on the return side of the pump in a floating condition. At the unactuated position of the power fluid valve 204, the valve communicates with the port P connecting the lines 162 leading to the piston ends of the large cylinder assemblies with the line 213 which communicates with the pump intake port 212 through the counterbalance valve 230, the line 225, and the line 261, the line 252, the line 262, the check valve 265, and the portion of the line 213 leading into the intake port 212. The power fluid discharged from the pump through the port 222 flows through the check valve 224 in the line 223, into the branch of the line 223 leading to the power fluid valve 205 which is communicating with the port P connecting the line 223 through the power fluid valve with the lines 216 directing the power fluid into the rod ends of the large cylinder assemblies above the pistons for forcing the pistons downwardly.

Depressing the operating lever of the control valve 409 applies a pilot pressure to the line 470 to the shuttle valve 461 moving the valve to a lower end position applying pilot pressure in the line 265 to the shuttle valve 435 which is moved downwardly to apply the pilot pressure in the line 442 to the shuttle valve 443. The shuttle valve 443 is moved downwardly supplying the pilot pressure in the line 444 to the shuttle valve 445 which is shifted to a lower end position communicating the pilot pressure to the line 450 connected with the shuttle valve 421 which is moved to a lower end position so that the pilot pressure is applied through the line 311 to actuate the power fluid valve 211. The valve 211 is connected with the valve port T thereby communicating the rod and piston ends of the small cylinder assemblies 42 with each other through the line 220 and 163. The application of the pilot pressure in the line 470 also shifts the shuttle valve 440 downwardly to supply the pilot pressure into the line 447 which is communicated into the shuttle valve 423 which is moved to a lower end position. The pilot pressure is applied from the shuttle valve 423 through the pilot line 304 to actuate the power fluid valve 210 shifting the valve to communicate with the return lines 261 so that the small cylinder assemblies 42 are floating on the return side of the pump 200 communicating with the intake port 212. Thus, the large cylinder assemblies 41 are driven downwardly by the power fluid pumped into the cylinders above the pistons while the small cylinder assemblies 42 are free floating. Since only the volume of the annular space in the large cylinder assemblies is being used in snub speed 2, compared to the annular rod end space in both cylinder assemblies in snub speed 1, snub speed 2 is an increment faster than snub speed 1. As the pistons are moving downwardly in both sets of cylinder assemblies 41 and 42, the fluid returns from each set of cylinders in the full space in the cylinders below the pistons exceeds the fluid flowing into the cylinders in the annular space above the pistons around the piston rods. A net return of fluid from the cylinder assemblies flows to the accumulator 253. The returns from the free floating small cylinder assemblies 42 flow directly into the return line 261 through which the returns flow to the accumulator in the line 252. The high pressure at the discharge port 222 of the pump 200 is applied through the pilot line 231 to the counter-balance valve 230 holding the counter-balance valve 230 open so that returns from the piston ends of the large cylinder assemblies 41 flowing through the valve 204 into the line 213 pass through the counter-balance valve 230 into the line 225 which intersects the line 261 through which the returns from the large cylinder assemblies then flow back to the accumulator 253. At the lower end of the stroke, the pump 200 is stopped and the operating lever of the valve 409 is released. The traveling slips are returned upwardly at whatever lift speed may be selected after the necessary traveling and fixed slip connections and disconnections have been made with the tubing string.

The system of FIG. 15 is operable at a snub speed 3 in which the large cylinder assemblies are free floating on the return side of the pump while the small cylinder assemblies 42 are working with power fluid being forced into the piston rod ends of the assemblies. The system is operated at snub speed 3 by discharging the pump 200 through the port 222 and intaking the pump through the port 212 while depressing the operating lever of the control valve 410. The effect of depressing the control valve lever is to actuate the power fluid valves 204 and 205 while the power fluid valves 210 and 211 remain unactuated. Pilot pressure is applied in the line 471 to the shuttle valve 462 which is shifted to a lower end position supplying the pilot pressure to the line 463 which shifts the shuttle valve 453 to a lower end position applying the pilot pressure through the pilot line 315 to actuate the power fluid valve 204. The pilot pressure in the line 471 is also applied to the shuttle valve 460 which moves downwardly to supply the pilot pressure in the line 464 to the shuttle valve 452 which is shifted to a lower end position supplying the pilot pressure in the line 454 to the shuttle valve 434. The shuttle valve 434 is moved downwardly to apply the pilot pressure in the line 441 to the shuttle valve 431 which is shifted downwardly communicating the pilot pressure through the line 432 to the shuttle valve 425. The shuttle valve 425 is shifted to a lower end position supplying pilot pressure through the line 320 to the power fluid valve 204 which is actuated to communicate with the port T. With the power fluid valves 204 and 205 both communicating with the valve ports T, the rod and piston ends of the large cylinder units are interconnected through the valve 205, the line 215, and the lines 162, while the lines 162 communicate through the valve 204 with the return line 261. Thus, the large cylinder assemblies are floating on the return side of the pump 200. Since the pistons 41*c* are moving downwardly, a portion of the fluids discharged below the pistons is returned to the accumulator through the lines 261 and 252. With both of the power fluid valves 210 and 211 unactuated, both valves communicate with the valve ports P. Since the pump 200 is discharging through the port 222, the line 223 is a power fluid supply line connected with the port P of the power fluid valve 211 which communicates the power fluid through the lines 221 into the rod ends of the small cylinder assemblies 42 for forcing the pistons downwardly. The piston ends of the small cylinder assemblies communicate through the lines 163 and the valve 210 with the lines 213 which are now connected with the intake port 212 of the pump 200 so that the return fluid from the piston ends of the small cylinder assemblies must pass through the counter-balance valve 230 which is being held open by the high pressure in the pilot line 231 communicated from the discharge side of the pump 200. A sufficient portion of the return fluid from both sets of cylinder assemblies is taken through the line 262, the filter 263, the check valve 265, and the portion of the line 213 leading into the pump 200 to supply the pump intake port 212 enough power fluid to deliver to the rod ends of the small cylinder assemblies. Since the space in the small cylinder assemblies at the rod ends is the smallest available into which power fluid may be pumped for forcing the cylinder assemblies downwardly, the snub speed 3 is the maximum speed of operation of the system. When the traveling slips reach the lower end of a stroke, the succeeding upward stroke is accomplished by shifting the system to one of the selected lift speeds and manipulating the traveling and fixed slips as previously discussed.

At each of the snub speeds 1, 2, and 3, the return fluids from the piston assemblies being powered must flow through the counter-balance valve 230 which meters the fluid responsive and proportional to the pilot pressure in the line 231 which senses the pressure in the line 223 on the discharge side of the pump 200. Thus, in inserting the tubing string into a well bore using one of the three available snub speeds, when conditions develop that the weight of the tubing string exceeds the upward force from the well pressure and, consquently, some holding or back pressure is needed to support the tubing weight, such back pressure is supplied by the regulating counter-balance valve 230. As power fluid pressure is required to force the tubing string downwardly, the effect of a reduction in such pressure is reflected on the discharge side of the pump 200 so that the pressure reduction sensed in the pilot line 231 will regulate the counter-balance valve 230 to reduce the return fluid rate of flow through the counter-balance valve from the piston assemblies.

In constructing a well tubing handling system in accordance with the invention, a number of factors will require consideration. Certain operating parameters and objectives must be assumed. In accordance with the invention, the system may be designed to produce a multiplicity of lift and snubbing speeds. In a typical system constructed and operated in accordance with the invention, it was assumed that the system would lift a maximum weight of 376,986 pounds over a range of five lift speeds operating with a 12 foot stroke and powered by a pump delivering 200 gallons per minute at 3,000 psi. It was decided that the lift speed gradations would be determined by assigning 20 percent increments to the range of weight to be lifted in the system such that at lift speed 1 the maximum weight would be lifted while at lift speed 5 approximately 20 percent of the maximum capacity would be lifted. Using such design criteria, it was determined that the large and small pairs of piston and cylinder units 41 and 42 would have the following dimensions:

| | LARGE CYLINDER UNITS 41 | | SMALL CYLINDER UNITS 42 | |
|---|---|---|---|---|
| | Diameter | Area | Diameter | Area |
| Cylinder | 8 in. | 30.265 sq. in. | 5½ in. | 23.758 sq. in. |
| Rod | 5½ in. | 23.758 sq. in. | 4 in. | 12.566 sq. in. |
| Annulus at Rod End | | 26.507 sq. in. | | 11.192 sq. in |

Utilizing the above cylinder unit specifications, the following relationships were found for the five lift speeds for which the system was designed:

| | LIFT | | | | |
|---|---|---|---|---|---|
| | Speed 1 | Speed 2 | Speed 3 | Speed 4 | Speed 5 |
| Lift Wt. Lbs. | 376,896 | 301,590 | 217,944 | 142,548 | 75,396 |
| Rate - Ft./Sec. | 0.51 | 0.64 | 0.88 | 1.35 | 2.55 |
| Stroke Time-Sec. | 23.5 | 18.75 | 13.6 | 8.89 | 4.7 |

The system connected as illustrated in FIG. 14 provided the following conditions of operation at two snubbing speeds:

| | SNUBBING | |
|---|---|---|
| | Speed 1 | Speed 2 |
| Snub Wt. Lbs. | 159,042 | 67,152 |
| Support Wt. Lbs. | 376,986 | 75,396 |
| Rate - Ft./Sec. | 1.21 | 2.86 |
| Stroke Time-Sec. | 9.9 | 4.2 |

An analysis of the above data will indicate that the increments available in the five lift speeds between the minimum weight which can be lifted at speed 5 to the maximum weight which can be lifted at speed 1 is substantially 20 percent between each of the available speed designations. The rate of movement of the tubing string ranges from 0.51 feet per second at speed 1 to 2.55 feet per second at speed 5, while the corresponding decrease in the amount of time required for each stroke ranged from 23.5 seconds at speed 1 to 4.7 seconds at speed 5.

While the specific specifications and operating conditions for the system of FIG. 15 providing eight lift speeds and three snubbing speeds will not be given in detail, the same design approach is taken with such a system selecting 12.5 percent differential increments in the weight capacities at each of the speeds such that 100 percent lifting capacity is available at speed 1 which provides a minimum rate of movement while at speed 8 only 12.5 percent lifting capacity is available at the maximum speed.

It will be evident from the foregoing description and the accompanying drawings that the use of at least two sets of different size double-acting hydraulic cylinder and piston units for raising and lowering well tubing provides a substantial selection of available variations in the volume of the chambers in the cylinder assemblies into which power fluid is pumped so that at a given maximum constant discharge volume and pressure of a hydraulic fluid pump the rate of speed of operation of the system is maximum for the weight requirements on the system as determined by the selected chambers into which the power fluid is directed. By utilizing the different size cylinder assemblies and both ends of the cylinder assemblies, the substantial number of speed selections are made available. One or both of the cylinder assemblies may be used and either or both ends of either of both of the cylinder assemblies may be employed in the operation of the system. The system is further enhanced by the use of the telescoping stabilizing tube assembly having meshing splined concentric tubes nested within the cylinder assemblies and positioned in axial alignment with the axes of the fixed and traveling slips so that the tubing strings being inserted into and lifted from a well bore move along the central longitudinal axis of the stabilizing tube assembly. The stability provided by the telescoping tube assembly including resistance to twisting enables the system to be essentially self-supporting so that it may be mounted on a wellhead without the use of a cumbersome mast or other framework which is not only expensive but time consuming in erection and dismantling.

What is claimed is:

1. A well tubing handling system comprising: stationary gripping means for holding an elongated member being inserted into or removed from a well bore; traveling gripping means axially aligned with said stationary gripping means for engaging and moving an elongated member into and out of a well bore; power means for driving said traveling gripping means toward and away from a well bore including a plurality of hydraulic cylinder-piston units having substantially equal effective operating strokes and different effective cross-sectional working areas; and means for selectively directing hydraulic fluid to one or a combination of said hydraulic units for varying the lifting and snubbing capacity and speeds of movement of said traveling gripping means.

2. A well tubing handling system in accordance with claim 1 wherein each of said hydraulic cylinder-piston units is a double acting device comprising a cylinder, a piston, and a piston rod connected with said piston and having sealed chambers on opposite sides of said piston for hydraulic fluid, a first of said chambers being at a piston end of said cylinder and a second of said chambers being at the rod end of said cylinder comprising the annular space within said cylinder around said rod, conduit means interconnecting said first and second chambers, and valve means for directing hydraulic fluid to and from either or both of said chambers.

3. A well tubing handling system in accordance with claim 2 wherein said plurality of hydraulic cylinder-piston units comprises at least two sets of units of substantially equal operating stroke, each set comprising two units of equal size, the units of each of said sets being disposed on opposite sides of a longitudinal axis extending through the axes of said stationary and traveling gripping means, and said units being substantially equally circumferentially spaced around said longitudinal axis, the units of one of said sets of hydraulic units being of larger capacity than the other of said pairs of units.

4. A well tubing handling system in accordance with claim 3 wherein said hydraulic units are sized to permit operation of said system at a plurality of selected lift and snub speeds having weight handling capacities in selected increments ranging from a maximum capacity at a minimum speed to a minimum capacity at a maximum speed.

5. A well tubing handling system in accordance with claim 4 wherein said conduit means and valve means are connected to provide five lift speeds and two snub speeds.

6. A well tubing handling system in accordance with claim 4 wherein said conduit means and valve means are connected to provide eight lift speeds and three snub speeds.

7. A well tubing handling system in accordance with claim 4 including a reversible hydraulic fluid pump having at least two ports operable selectively at discharge or intake ports; hydraulic power fluid conduit means between said cylinder-piston units and said pump; directional control valve means in said conduit means leading to each pair of said cylinder-piston units for selectively directing hydraulic fluid to and from each of said chambers in said units; and speed control valves connected with said power fluid directional control valves for operating said directional control valves to selectively operate said system through said lift and snub speeds.

8. A well tubing handling system in accordance with claim 7 wherein said directional control valve means connected with said hydraulic units includes a first valve connected with conduits leading to the piston ends of said units of each pair of said units; a second valve connected with conduits leading to the rod ends of each of said units of each pair of said units; and conduit means interconnecting said first and second directional control valves for selectively communicating said chambers at opposite ends of each pair of said hydraulic units with each other.

9. A well tubing handling system in accordance with claim 8 including a telescoping stabilizing tube assembly mounted along the longitudinal axis of said stationary and said traveling gripping means including a first splined tube connected with said stationary gripping means and a second splined tube telescopically engaged and meshing with said first tube and connected with said traveling gripping means.

10. A snubbing system for lifting and lowering elongated members from and into a well bore comprising: mounting means for mounting said snubber on a wellhead; a support frame secured on said mounting means;

at least two sets of stationary gripping devices secured with said support frame positioned coaxial with each other and with said wellhead, one of said gripping devices holding an elongated member against a force toward said wellhead and the other of said gripping devices holding an elongated member against a force away from said wellhead; a telescoping stabilizer tube assembly mounted on said support frame including a first stationary internally splined tube secured at a first end with said support frame and a second traveling externally splined tube telescopically engaged and meshing at a first end into the second end of said stationary tube, said stabilizer tube assembly being positioned coaxial with said wellhead and said stationary gripping devices; a traveling tube gripping device secured on a second end of said traveling tube aligned coaxial with said stabilizer tube assembly; at least two pairs of hydraulic cylinder-piston units of substantially equal operating stroke longitudinally aligned with the longitudinal axis of said stabilizer tube assembly and circumferentially spaced around said stabilizer tube assembly, said hydraulic units being supported at first ends from said support frame and being secured at second opposite ends with said traveling gripping device for raising and lowering said traveling gripping device, each of said pairs of hydraulic units comprising units of the same size disposed on opposite sides of said stabilizer tube assembly, one pair of said hydraulic units being larger than the other pair of said hydraulic units, each of said hydraulic units being double acting including a first pressure chamber at a piston end of said unit comprising the full bore of the cylinder of said unit and a second pressure chamber at the rod end of said unit comprising an annular space within the cylinder of said unit around the piston end of said unit; and conduit and valve means connected with said hydraulic units for selectively supplying hydraulic fluid to said hydraulic units and returning hydraulic power fluid from said hydraulic units, including means for selectively directing hydraulic fluid into either or both of said chambers of either or both sets of said hydraulic units for operating said hydraulic units and said traveling gripping device at any one of a plurality of lifting and snubbing speeds.

11. A snubber in accordance with claim 10 including a bearing supporting said traveling gripping device for absorbing longitudinal and radial forces permitting said traveling gripping device to rotate as said device is raised and lowered.

12. A snubber in accordance with claim 11 including a tubing tong unit supported on said traveling gripping means for rotating an elongated member being supported and raised and lowered by said traveling gripping means.

13. A snubber in accordance with claim 12 wherein the sizing of said pairs of hydraulic units and said conduits and valves connected with said units provides for operation of said system over a range of five lifting and two snubbing speeds, said lifting speeds being selected to permit changes in the lifting capacity of said traveling gripping devices in approximately 20 percent increments.

14. A snubber in accordance with claim 12 wherein the sizing of said pairs of hydraulic units and said conduits and valves connected with said units provides for operation of said system over a range of eight lift and three snubbing speeds, said lifting speeds being selected to permit changes in the lifting capacity of said device in about twelve and one-half percent increments.

15. A snubbing system for running and pulling a well tubing in a well bore comprising: mounting plate means for securing said snubbing system on the upper end of a blowout preventer stack in a wellhead; at least two sets of stationary slips aligned with axes coaxially with the longitudinal axis of said blowout preventer stack and spaced along said longitudinal axis, one of said slips adapted to hold an elongated member against a force toward said wellhead and the other of said slips adapted to hold an elongated member against a force away from said wellhead; a stabilizer tube assembly secured with said mounting plate aligned coaxially with said stationary slips on the other side of said slips from said mounting plate, said stabilizer tube assembly including an outer stationary tube secured at a first end adjacent to said stationary slips and including along an opposite end portion an internal splined guide ring, an internal traveling tube concentrically disposed within said stationary outer tube, said internal traveling tube having external splines meshing with said internal splined guide ring of said outer tube permitting said internal tube to slide longitudinally telescopically in said outer tube over the length of a desired stroke while holding said inner tube against rotation relative to said outer tube; a traveling slips mounting plate supported on the external end of said inner tube of said stabilizer tube assembly; at least two sets of hydraulic cylinder-piston units of substantially equal operating stroke supported in circumferentially spaced relation around said stabilizer tube assembly, said hydraulic units being mounted at first ends from said mounting plate at said stationary slips and piston rods of said hydraulic units being secured with said traveling slip mounting plate for raising and lowering said traveling slip mounting plate responsive to hydraulic fluid pressure in said hydraulic units, each set of said hydraulic units comprising at least two units of equal size, one of said sets comprising units larger in size than the other of said sets, and each of said hydraulic units being a double-acting hydraulic ram system having a pressure working chamber at the piston end of the cylinder of said unit and a hydraulic fluid working chamber in the annular space within said cylinder around said piston rod on the opposite side of said piston; a rotatable slip bowl assembly mounted on said traveling slip mounting plate; a set of reversible traveling slips mounted on said slip bowl assembly for gripping and moving an elongated member into a well bore at a first position and for gripping and moving an elongated member out of a well bore at a second position; a hydraulic pump for pumping hydraulic working fluid to said hydraulic units for extending and retracting said piston rods of said units for raising and lowering said traveling slips; conduit means connecting said pump with said hydraulic units leading into the working fluid pressure chambers at both the piston and rod ends of said hydraulic units; working fluid directional control valves in said conduits between said pump and said hydraulic units for controlling work fluid flow to each of said chambers at both the rod and piston ends of said units and for communicating the chambers at the rod ends of each of said units with the chambers at the piston ends of each of said units; and control means connected with said working fluid valves for selectively operating said working fluid valves to selectively direct hydraulic working fluid to any one of or a combination of the working fluid chambers of said hydraulic units for varying the working capacity and speeds of operation of said traveling slips.

16. A snubbing system in accordance with claim 15 wherein the size relationships of said working fluid chambers of said hydraulic units are selected to provide a plurality of working capacities and speeds divided over substantially equal increments ranging from a maximum to a minimum capacity.

17. A snubbing system in accordance with claim 16 including a set of tubing tongs mounted on said traveling slips for rotating an elongated member gripped by said traveling slips.

18. A snubbing system in accordance with claim 16 wherein said working chambers of said hydraulic units are sized and said control means is connected to provide five lift speeds and two snub speeds.

19. A snubbing system in accordance with claim 16 wherein said working chambers of said hydraulic units and said control means provide for operation of said system in eight lift speeds and three snub speeds.

* * * * *